US006492983B2

(12) United States Patent
Nishitani et al.

(10) Patent No.: US 6,492,983 B2
(45) **Date of Patent: *Dec. 10, 2002**

(54) VIDEO SIGNAL DISPLAY SYSTEM

(75) Inventors: Shigeyuki Nishitani; Naruhiko Kasai, both of Yokohama; Hiroshi Kurihara, Mobara; Tatsumi Mori, Isehara; Yukio Hiruta; Masashi Mori, both of Fujisawa, all of (JP)

(73) Assignees: Hitachi, Ltd., Tokyo (JP); Hitachi Video and Information Systems, Inc., Yokohoma (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/912,603

(22) Filed: Jul. 26, 2001

(65) Prior Publication Data

US 2001/0045947 A1 Nov. 29, 2001

Related U.S. Application Data

(63) Continuation of application No. 09/316,959, filed on May 24, 1999, now Pat. No. 6,297,816.

(30) Foreign Application Priority Data

May 22, 1998 (JP) ..... 10-140837
Nov. 20, 1998 (JP) ..... 10-330901

(51) Int. Cl.[7] ..... G09G 5/00
(52) U.S. Cl. ..... 345/213; 345/89

(58) Field of Search ..... 345/204, 213, 345/98, 99, 89, 690; 348/500, 525, 540, 476–485

(56) References Cited

U.S. PATENT DOCUMENTS 4,361,852 A * 11/1982 Katzfey
4,977,445 A 12/1990 Kawai
5,426,466 A * 6/1995 Bocox et al.
5,506,600 A 4/1996 Ooki et al.
5,633,688 A 5/1997 Choi et al.
6,297,816 B1 * 10/2001 Nishitani et al. ..... 345/213

* cited by examiner

*Primary Examiner*—Regina Liang
(74) *Attorney, Agent, or Firm*—Antonelli, Terry, Stout & Kraus, LLP

(57) ABSTRACT

A video signal output device which outputs a video signal, including a basic signal group generating circuit for generating a sync signal and a video signal, the video signal indicating display values of pixels at display positions on a display device in intervals of the video signal, the display positions being determined in accordance with time differences between the intervals of the video signal and the sync signal; a signal generating circuit for generating a transmission signal relating to the video signal to be transmitted to the display device; a superposing circuit for superposing the transmission signal on the sync signal to generate a second sync signal; and an output circuit for outputting the second sync signal and the video signal.

3 Claims, 35 Drawing Sheets

MONITOR SETTING SIGNAL 99

EXAMPLE OF MONITOR SETTING SIGNAL 99

EXAMPLE OF MONITOR SETTING SIGNAL 99

| INPUT VIDEO SIGNAL 71 | OUTPUT VIDEO SIGNAL 73 |
|---|---|
| 00 | 00 |
| 01 | 00 |
| 02 | 01 |
| ⋮ | ⋮ |
| 80 | 72 |
| 81 | 73 |
| ⋮ | ⋮ |
| FC | FA |
| FD | FC |
| FE | FD |
| FF | FF |

VIDEO SIGNAL DISPLAY SYSTEM

CROSS-REFERENCE TO RELATED APPLICATION

This application is a continuation of application Ser. No. 09/316,959 filed on May 24, 1999, now U.S. Pat. No. 6,297,816, the contents of which are hereby incorporated herein by reference in their entirety.

BACKGROUND OF THE INVENTION

The present invention relates to an analog video signal display unit, and, in particular, to a transmission device for analog video signal and method therefor, which serve for high quality display in a liquid crystal display monitor using a liquid crystal panel. Further, the present invention relates to an image display system, in which video signal and sync signal are transmitted from a video signal output device to a display unit, to be displayed there.

In a conventional technique, as the image display system that transmits video signal and sync signal from a video signal output device to a display unit for displaying there, there is known one comprising a graphics card mounted in a computer unit and a liquid crystal display monitor.

FIG. 18 shows a configuration of such a conventional image display system.

In the figure, a reference numeral 24 refers to a liquid crystal display monitor, and 1 to a graphics card mounted in a computer unit.

Here, the graphics card 1 comprises a video memory 3 and a graphics controller 2.

The graphics controller 2 comprises a memory control circuit 5 for controlling read and write of display data from and into the video memory 3, a reference clock generator 4 for generating, from a prescribed system clock 10, a clock 11 which is to be a reference for operation of the graphics controller 2, a sync signal generator 9 for generating, from the clock 11, vertical sync signal 21 and horizontal sync signal 22, and D-A converters 6, 7, 8 for converting the display data read from the video memory 3 to analog video signals being synchronized with the clock 11. In such a configuration, the graphics controller 2 sequentially reads the display data stored in the video memory 3, in synchronization with the vertical sync signal 21 and horizontal sync signal 22. Then, it converts them in the D-A converters 6, 7, 8, and outputs them as the analog video signals 18, 19, 20. On the other hand, the liquid crystal display monitor 24 comprises A-D converters 28, 29, 30 for converting analog video signals 18, 19, 20 to digital video signals 32, 33, 34, a PLL 27 for generating, from the horizontal sync signal 22, a conversion clock 31 for the A-D converters 28, 29, 30, a liquid crystal display controller 25, and a liquid crystal display unit 26.

In such a configuration, sampling is carried out on the analog video signals 18, 19, 20 inputted from the graphics card 1, in synchronization with the conversion clock 31 generated by the PLL 27, to convert them into digital video signals 32, 33, 34. The liquid crystal display controller 25 displays the digital video signals 32, 33, 34 on the liquid crystal display unit 26, synchronizing them with the horizontal sync signal 22 and vertical sync signal 21.

An example of timing for each signal outputted from the graphics card 1 to the liquid crystal display monitor 24 is shown in FIG. 19.

FIG. 19 is a timing chart showing relationship between the horizontal sync signal 22, the video signals 18, 19, 20, and the clock 11. One horizontal interval for the analog video signals (interval for outputting the video signals corresponding to one display line) comprises a display effective interval and a fly-back interval. The analog video signals and horizontal sync signal are synchronized with the clock 11, and, in a case where a display resolution is 1024 dots in the horizontal direction, the display effective interval corresponds to 1024 clocks, and the fly-back interval corresponds to 304 clocks. Thus, one horizontal interval corresponds to 1328 clocks in total.

On the other hand, in the liquid crystal display monitor 24, the PLL 27 generates the conversion clock 31 synchronized in phase with the horizontal sync signal 22. As shown in FIG. 20, this conversion clock 31 is generated as 1328 clocks for a single period of horizontal sync signal 22. The conversion clock 31 is inputted into the A-D converters 28, 29, 30 to convert the analog video signals 18, 19, 20 to the digital video signals 32, 33, 34. Then, the digital video signals 32, 33, 34 are converted by the liquid crystal display controller 25, into liquid crystal display data 35 to be displayed with liquid crystal, and the liquid crystal display unit 26 displays the image.

In the image display system of such configuration as shown in FIG. 18, it is necessary that the clock 11 generated by the reference clock generator 4 of the graphics card 1 and the conversion clock 31 generated by the PLL 27 of the liquid crystal display monitor 24 coincide to some extent with each other in their phases. When the phases of both clocks deviate largely from each other in their phases, it becomes impossible that the video signals 18, 19, 20 which are made to be analog in the D-A converters 6, 7, 8 being synchronized with the clock 11 are correctly converted in the A-D converters 28, 29, 30 in synchronization with the conversion clock 31. In other words, as shown in FIG. 21C, in A-D conversion, the video signals 18, 19, 20 should be properly converted at a flat portion of their signal waveform AD. However, when phase difference δ between both clocks becomes larger, A-D conversion of the video signals 18, 19, 20 are carried out at a portion deviated from the flat portion of the signal waveform, as shown in FIG. 21D. This results in A-D conversion error, which then produces flicker of the display.

However, as the resolution of the liquid crystal display monitor 24 becomes higher, or, in other words, as the frequencies of the clock 11 and conversion clock 31 become higher, it becomes more difficult to make the phases of both clocks coincide with each other owing to problems related to the precision of the clock 11.

Namely, it is inevitable anyway that the period of the clock 11 generated by the reference clock generator 4 varies very slightly for each period, owing to effects of noises from other digital circuits and owing to problems related to the performance etc. On the other hand, the PLL 27 of the liquid crystal display monitor 24 generates the conversion clock 31 as a clock synchronized in phase with the horizontal sync signal 22, whose period is a single horizontal interval. Even if the PLL 27 is ideal one, it is impossible to make the phase of the conversion clock 31 follow up the clock 11 in its phase fluctuation in a single horizontal interval.

For that reason, the phase difference δ between the clock 11 and the conversion clock 31 varies within a single horizontal interval as shown in FIG. 21B. When the liquid crystal display monitor 24 has high resolution, the phase difference δ determined relatively as deviation between clock periods becomes large. This produces flicker of the display owing to the above-described A-D conversion error.

On the other hand, when the graphics card 1 transmits the clock 11 to the liquid crystal display monitor 24, and the liquid crystal display monitor 24 uses it as the conversion clock 31, it is possible to prevent occurrence of such phase difference δ. In that case, however, in addition to transmission lines for transmitting the video signals 18, 19, 20 and the sync signals, another transmission line for transmitting the clock is required.

Further, in the conventional image display system, for transmitting audio signal and various setting information for the display unit from the video signal output device to the display unit, respective dedicated transmission lines are required. Thus, there has been such a problem that the number of transmission lines connecting both devices increases, and it brings complexity, also.

SUMMARY OF THE INVENTION

Thus, an object of the present invention is to provide an image display system that can transmit various signals from a video signal output device to a display unit without requiring a dedicated transmission line. Further object of the present invention is to reduce A-D conversion error in a display unit by utilizing such-transmitted signals, and to suppress flicker of the display.

The above objects can be attained by providing an analog video signal display apparatus, comprising:

a computer unit for sending an analog video signal, a vertical sync signal and a horizontal sync signal synchronized with the video signal; and an image display device for displaying an image from the video signal, the vertical sync signal, and the horizontal sync signal, wherein:

the computer unit comprises a horizontal dividing signal synthesizing circuit for generating a horizontal dividing signal obtained by dividing one period of the horizontal sync signal into equal parts, and for sending a horizontal dividing sync signal obtained by superposing the horizontal dividing signal on the horizontal sync signal;

the image display device comprises an analog/digital conversion circuit for converting the analog video signal to a digital video signal, a sync signal isolating circuit for reproducing and isolating the horizontal sync signal and the horizontal dividing signal from the horizontal dividing sync signal, to be used for displaying the image, a conversion clock generating circuit for generating a conversion clock for the analog/digital conversion circuit from the horizontal dividing sync signal, and an image display unit for displaying the digital video signal.

Further, to attain the above objects, the present invention provides an image display system, comprising:

a video signal output device for outputting a video signal; and an image display device for receiving and displaying the video signal, wherein:

the video signal output device comprises:

a basic signal group generating means for generating a sync signal, and the video signal that indicates display values of pixels at positions decided in each interval by time difference between the interval and the sync signal;

a signal generating means for generating a prescribed transmission signal to be transmitted to the display device, other than a horizontal sync signal or a vertical sync signal;

a superposing means for superposing the transmission signal on the sync signal to generate a second sync signal; and an output means for outputting the second sync signal and the video signal to the display device, wherein:

the image display device comprises:

an isolating means for isolating, from the second sync signal to be inputted, the transmission signal and the sync signal superposed in the second sync signal;

a processing means for processing the isolated transmission signal; and a display means for displaying the display values indicated in each interval by the inputted video signal, the display values being displayed at pixels at positions decided by time difference between the interval and the isolated sync signal.

According to thus-described video signal display system, it is possible to transmit a variety of signals from the video signal output device to the display device using the same transmission lines which transmit the sync signals.

Further, the present invention have the following construction.

Namely, in thus-described video signal display system, wherein:

the video signal is an analog video signal;

the signal generating means of the video signal output device generates, as the transmission signal, a periodic signal synchronized with a period for switching pixels whose display values are expressed by the analog video signal, the periodic signal having a shorter period than a horizontal period, i.e., a period for switching a display line to which the pixels whose display values are expressed by the analog video signal belongs; and the processing means of the image display device comprises a conversion clock generating means for generating a conversion clock signal synchronized with the isolated periodic signal, and a conversion means for converting the inputted analog video signal to a digital video signal being synchronized with the conversion clock signal.

Further, the present invention provides thus-described image display system, wherein:

the video signal is an analog video signal;

the signal generating means of the video signal output device generates, as the transmission signal, a periodic signal synchronized with a period for switching pixels whose values are expressed by the analog video signal, the periodic signal having the same period as the period; and the processing means of the image display device comprises a conversion means for converting the inputted analog video signal to a digital video signal, being synchronized with the isolated periodic signal.

According to thus-described image display systems, the same transmission line is used for transmitting the sync signal and for transmitting a periodic signal synchronized with a period for switching pixels whose display values are expressed by the analog video signal, the periodic signal having a shorter period than a horizontal period, i.e., a period of the horizontal sync signal. In the display device, the conversion clock synchronized with this periodic signal is used for A-D conversion of the analog video signal. Accordingly, in the display device, it is possible to suppress the phase difference between the conversion clock and the period for switching the pixels whose display values are expressed by the analog video signal, making the phase difference smaller in comparison with the case that the conversion clock synchronized with the horizontal sync signal is used. Accordingly, it is possible to reduce A-D conversion error and to prevent flicker of display.

It is noted that this application is based on applications No. 10-140837 and No. 10-330901 filed in Japan, the contents of which are incorporated herein by reference.

DESCRIPTION OF THE PREFERRED EMBODIMENTS

Now, a first embodiment of the present invention will be described referring to FIGS. 1–8.

Figure 1:
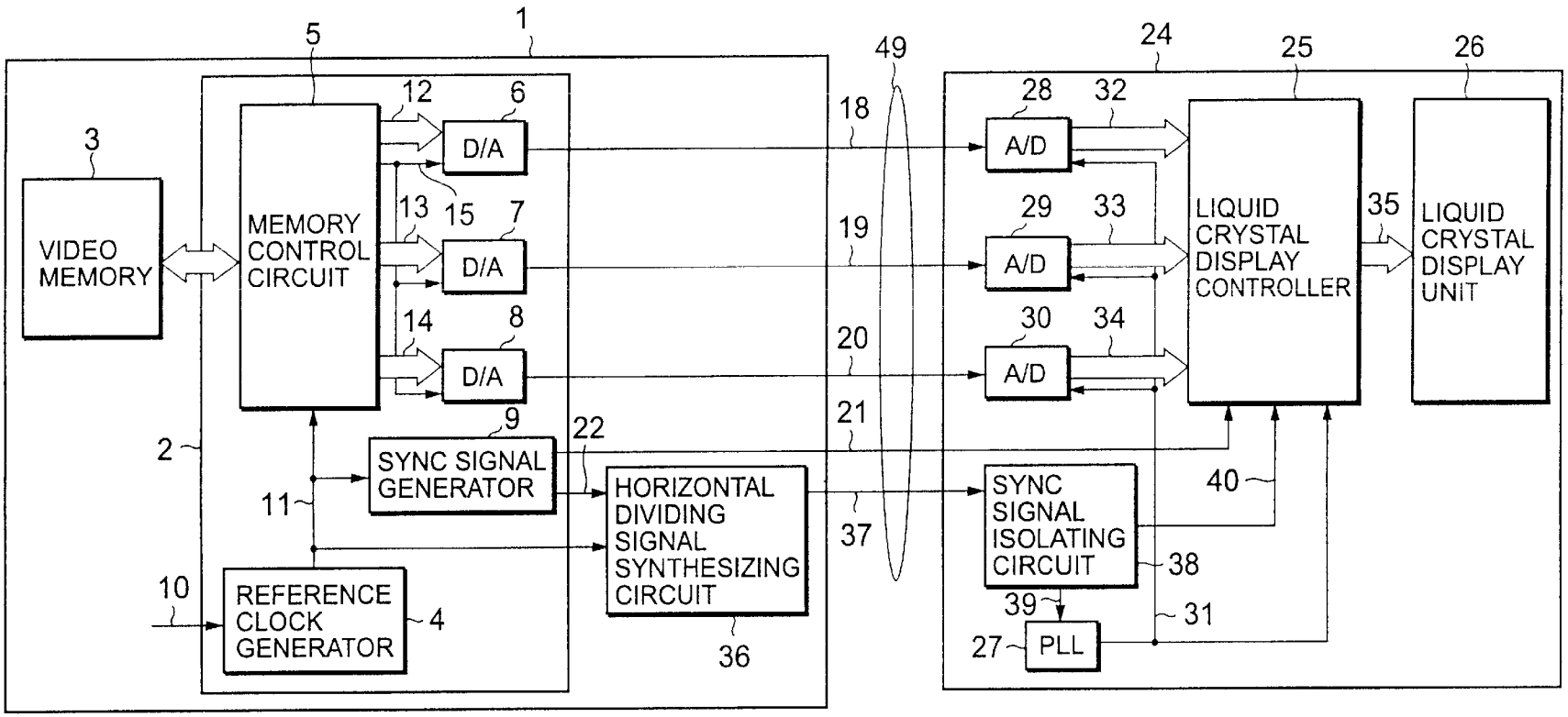
FIG. 1 is a block diagram showing a configuration of an image display system according to first and sixth embodiments of the present invention.

FIG. 1 is a block diagram showing an embodiment of a computer unit and a liquid crystal display monitor, to which the present invention is applied.

The reference numeral 1 refers to a graphics card connected to the computer system; 2 to a graphics controller for generating video signal; 3 to a video memory for storing video signal; 4 to a reference clock generator for generating a clock that becomes a reference for operation of the graphics controller 2; 5 to a memory control circuit for reading and writing image data stored in the video memory 3 and for outputting the read image data; 6, 7, 8 to D-A converters, each for converting image data outputted from the memory control circuit 5 to an analog video signal; 9 to a sync signal generator for generating a vertical sync signal and a horizontal sync signal from the clock generated by the reference clock generator 4; 10 to a system clock that becomes a reference for operation of the clock generated by the reference clock generator 4; 11 to a clock generated by the reference clock generator 4; 12, 13, 14 to digital image data outputted by the memory control circuit 5; 15 to a conversion clock that is obtained by adjusting phase of the clock 11 and used by the D-A converters 6, 7, 8 for converting the digital image data 12, 13, 14 to analog video signals; 18, 19, 20 to the analog video signals outputted by the D-A converters 6, 7, 8; 21 to a vertical sync signal synchronized with the analog video signals 18, 19, 20; 22 to a horizontal sync signal synchronized with the analog video signals 18, 19, 20; 24 to a liquid crystal display monitor for displaying the analog video signals 18, 19, 20; 25 to a liquid crystal display controller for converting timings of the video signals for displaying them on liquid crystal; 26 to the liquid crystal display unit for displaying the video signals; 27 to a PLL for generating a clock from horizontal dividing signal isolated from horizontal sync signal 22, to be used for A-D conversion of the video signals 18, 19, 20 and to become reference for operation of the liquid crystal display controller 25; 28, 29, 30 to A-D converters for converting the analog video signals 18, 19, 20 to digital video signals; 31 to the conversion clock generated by the PLL; 32, 33, 34 to the digital video signals outputted by the A-D converters 28, 29, 30; 35 to liquid crystal display data adjusted in its timing for the liquid crystal display and outputted by liquid crystal display controller 25; 36 to a horizontal dividing signal synthesizing circuit for generating a horizontal dividing signal from the clock 11 generated by the reference clock generator 4 and for generating second horizontal sync signal from the horizontal dividing signal and the horizontal sync signal 22 generated by the sync signal generator 9; 37 to the second horizontal sync signal outputted by the horizontal dividing signal synthesizing circuit 36; 38 to a sync signal isolating circuit for isolating and reproducing the horizontal sync signal and the horizontal dividing signal from the second horizontal sync signal; and 39 to the horizontal dividing signal outputted by the sync signal isolating circuit 38.

In FIG. 1, characteristics of the present invention lie in that the graphics card 1 is provided with the horizontal dividing signal synthesizing circuit 36, and, further, the liquid crystal display monitor 24 is provided with the sync signal isolating circuit 38. In the following, operation of these devices will be described referring to FIGS. 2–8.

Figure 2:
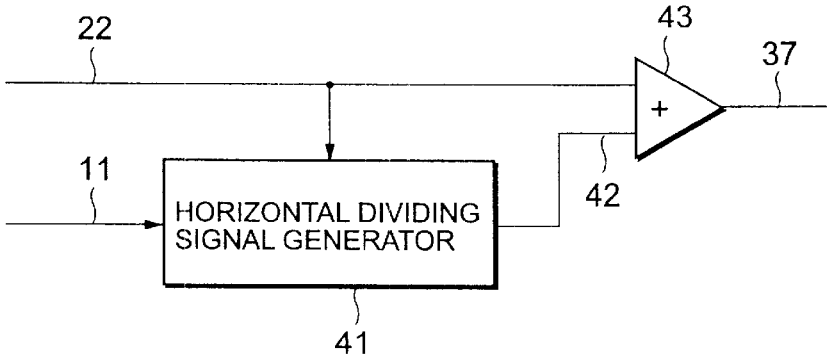
FIG. 2 is a block diagram showing a configuration of a horizontal dividing signal synthesizing circuit according to the first and sixth embodiments of the present invention.
Figure 3:
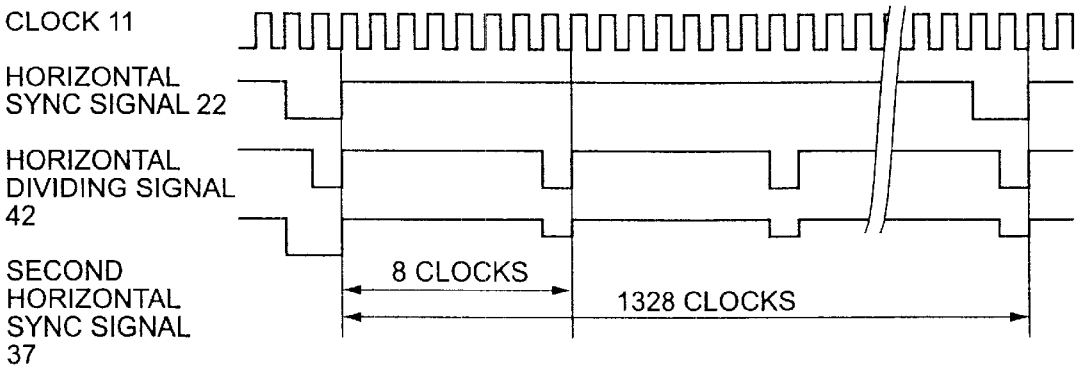
FIG. 3 is a view showing how to horizontal dividing signals are generated according to the first and sixth embodiments of the present invention.
Figure 4:
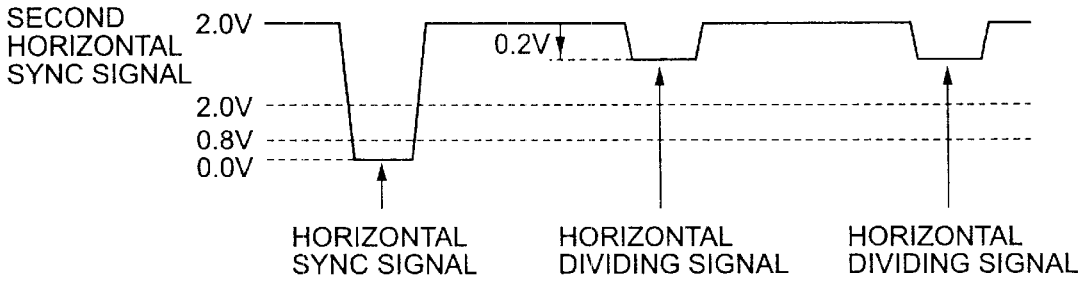
FIG. 4 is a view showing voltage levels of a second horizontal dividing signal according to the first and sixth embodiments of the present invention.

FIG. 2 is a detailed block diagram of the horizontal dividing signal synthesizing circuit 36. The horizontal dividing signal synthesizing circuit 36 comprises a horizontal dividing signal generator 41 and an analog adder 43. The horizontal dividing signal generator 41 divides the frequency of the clock 11 to generate a horizontal dividing signal 42. The horizontal dividing signal 42 outputted by the horizontal dividing signal generator 41 is synchronized with the horizontal sync signal 22 and outputted. Then, the horizontal dividing signal 42 is added to the horizontal sync signal 22 by the analog adder 43, and outputted as a second horizontal sync signal 37. The process of producing this second horizontal sync signal 37 is described referring to FIGS. 3 and 4. FIG. 3 is a timing chart showing waveforms at respective parts of FIG. 2. The clock 11 is the clock outputted by the reference clock generator 4 (FIG. 1), and, in the case that display resolution is 1024×768 dots and frame frequency is 70 Hz, the clock 11 is a high speed clock of about 75 MHz. This clock 11 is the same clock as the conversion clock 15 used for D-A conversion to the analog video signals 18, 19, 20 in the D-A converters 6, 7, 8 (FIG. 1). The horizontal dividing signal generator 41 divides the frequency of the clock 11 to generates the horizontal dividing signal 42. As shown in FIG. 3, the horizontal dividing signal 42 is obtained by dividing the frequency of the clock 11 by eight, and is synchronized with the horizontal sync signal 22. The horizontal sync signal 22 has a period of 1328 clocks, as described in the conventional case. Accordingly, the horizontal dividing signal 42 divides the horizontal sync signal 22 into 166 parts. Such horizontal dividing signal 42 and horizontal sync signal 22 are synthesized in the adder 43, to be outputted as the second horizontal sync signal 37. The second horizontal sync signal 37 is a signal obtained by adding the horizontal sync signal 22 and weighted horizontal dividing signal 42 in an analog manner. This will be explained referring to FIG. 4. FIG. 4 is an example showing voltage relationship between each parts of the second horizontal sync signal 37. The second horizontal sync signal 37 is a TTL level logic signal of negative logic having amplitude of (5 v–0 v) in the timing of the horizontal sync signal, and is rectangular wave of micro voltage having amplitude of 0.2 v from 5 v in the timing of the horizontal dividing signal. The horizontal sync signal has such signal amplitude that crosses thresholds determining TTL logic, i.e., TTL logic thresholds defined as "logical 1 is 2.0 v or more, and logical 0 is 0.8 v or less". On the other hand, the horizontal dividing signal has micro amplitude while maintaining the voltage of logical 1 of TTL (i.e., 2.0 v or more). Accordingly, in FIG. 4, seen from the viewpoint of TTL logic, the second horizontal sync signal 37 itself is simply the horizontal sync signal outputted from the adder 43, while, from the viewpoint of the micro signal level, it is seen as if micro pulse expressing the horizontal dividing signal is periodically outputted at every 8th clock.

Further, there will be described a method of realizing display on the liquid crystal display monitor 24 from thus-described second horizontal sync signal 37. First, the second horizontal sync signal 37 is inputted into the sync signal isolating circuit 38 of the liquid crystal display monitor 24. The sync signal isolating circuit 38 is a circuit for isolating a horizontal sync signal 40 and a horizontal dividing signal 39 from the second horizontal sync signal 37. Configuration and operation of this sync signal isolating circuit 38 will be described referring to FIGS. 5–7.

Figure 5:
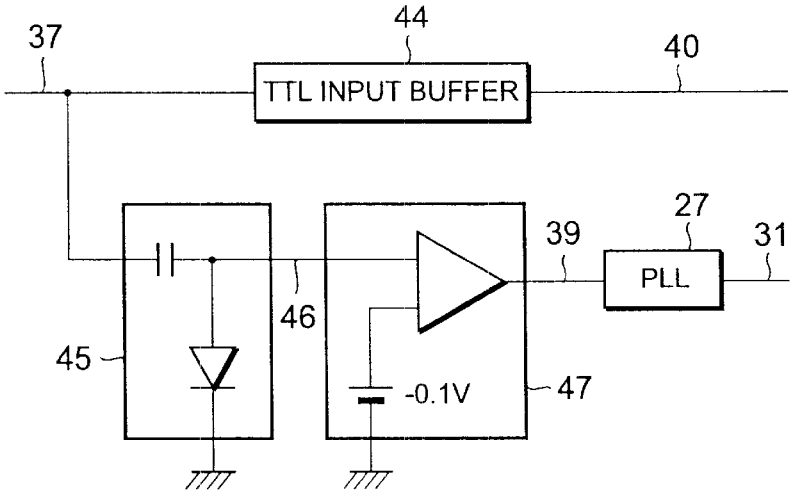
FIG. 5 is a block diagram showing a configuration of a sync signal isolating circuit according to the first and sixth embodiments of the present invention.

FIG. 5 is a block diagram showing the configuration of the sync signal isolating circuit 38. The sync signal isolating circuit 38 comprises a TTL input buffer 44, a clamping circuit 45, and a comparator 47. The second horizontal sync signal 37 is inputted into both the TTL input buffer 44 and the clamping circuit 45. The second horizontal sync signal 37 inputted into the TTL buffer 44 is outputted as the horizontal sync signal 40, and the second horizontal sync signal 37 inputted into the clamping circuit 45 is outputted as clamp voltage 46. Further, the clamp voltage 46 is inputted into the comparator 47, converted into the horizontal dividing signal 39, and inputted into the PLL 27 as reference clock.

Figure 6:
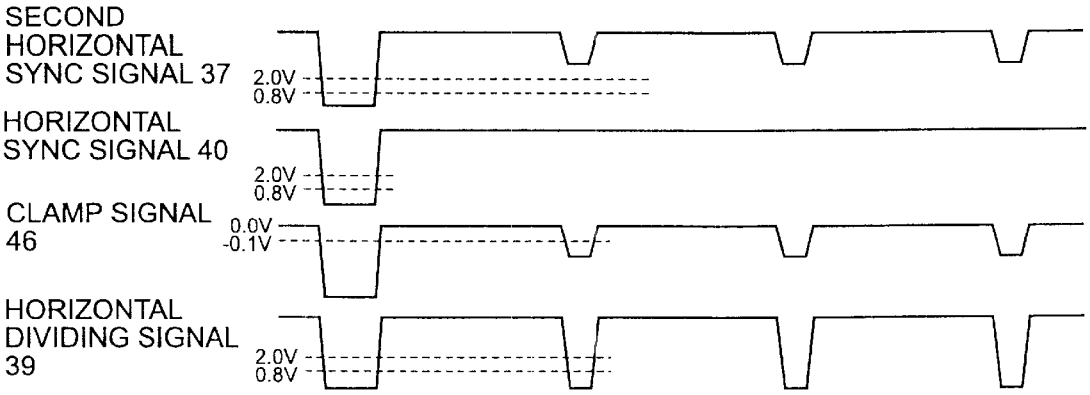
FIG. 6 is a view showing isolation of the horizontal dividing signal according to the first and sixth embodiments of the present invention.
Figure 7:
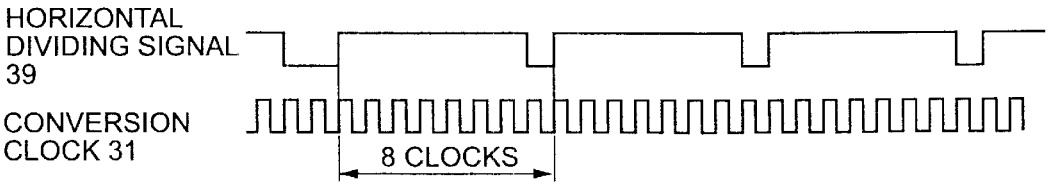
FIG. 7 is a view showing operation of a PLL according to the first and sixth embodiments of the present invention.

Referring to FIGS. 6 and 7 also, more detailed description will be given. The TTL input buffer 44 is a buffer circuit that has an input terminal for TTL logic and transfers input waveform to its output. The second horizontal sync signal 37 inputted into the TTL input buffer 44 is shaped in its waveform in accordance with the TTL logic thresholds and outputted as the horizontal sync signal 40. Further, the clamping circuit 45 is a circuit for converting reference voltage in such a manner that the highest voltage level (the level of logical 1) of the second horizontal sync signal 37 is made to be a reference level and this level is converted to 0 v. The clamping circuit 45 comprises a condenser and a diode. By inputting the second horizontal sync signal 37 into this clamping circuit 45, the clamp voltage 46 is generated. Next, the clamp voltage 46 is inputted into the comparator 47. The comparator 47 is a circuit that outputs TTL logical 1 when the inputted signal is −0.1 v or more, and outputs TTL logical 0 when the inputted signal is less than −0.1 v. The clamp voltage 46 is a voltage having the maximum of 0 v, and, by inputting the clamp voltage 46 into the comparator 47, it is possible to isolate the horizontal dividing signal 39. The isolated horizontal dividing signal 39 is inputted into the PLL 27 as its reference clock, and, as shown in FIG. 7, the PLL 27 generates the conversion clock 31. By setting the PLL 27 to generate a clock having a period of one eighth period from the horizontal dividing signal 39, the PLL 27 generates the conversion clock 31. This conversion clock 31 is used in the A-D converters 28, 29, 30 to convert the analog video signals 18, 19, 20 to the digital video signal 32, 33, 34. After that, the liquid crystal display controller 25 converts the timing of the video signals to the timing for the liquid crystal display, so as to display the image on the liquid crystal display unit 26.

Figure 8:
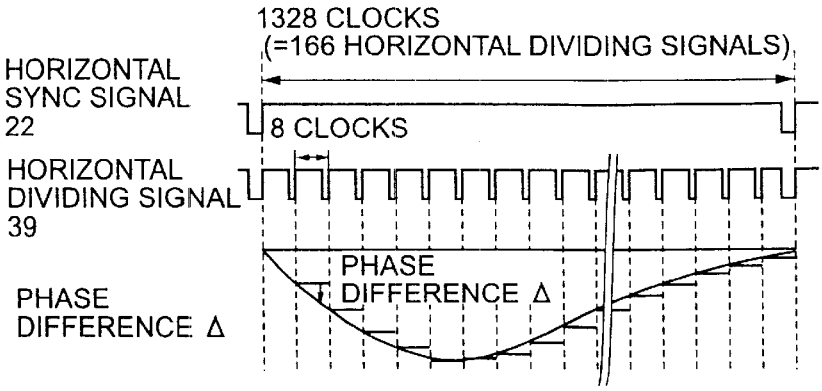
FIG. 8 is a view showing phase difference of clocks according to the first and sixth embodiments of the present invention.

As described above, in displaying the analog video signal on the liquid crystal display monitor, the clock for converting the analog video signals to the digital video signals is generated by using the horizontal dividing signal added to the horizontal sync signal, and, by that, flicker of the display can be suppressed. As shown in FIG. 8, the PLL 27 generates the conversion clock 31 using the horizontal dividing signal 39, which divides the horizontal sync signal 22 having a period corresponding to 1328 clocks into 166 equal parts, that is, which has a period corresponding to 8 clocks (=1328 clocks÷166), as a reference clock. Accordingly, the flicker owing to the A-D conversion error caused by the phase difference δ between the clock 11 and the conversion clock 31, which has been a problem in the conventional technique, is largely compressed to have the phase difference δ to 1/166 on average according to the present embodiment. Accordingly, the flicker owing to the A-D conversion error caused by the phase difference δ is scarcely generated, and it is possible to attain high quality display without flicker.

Figure 9:
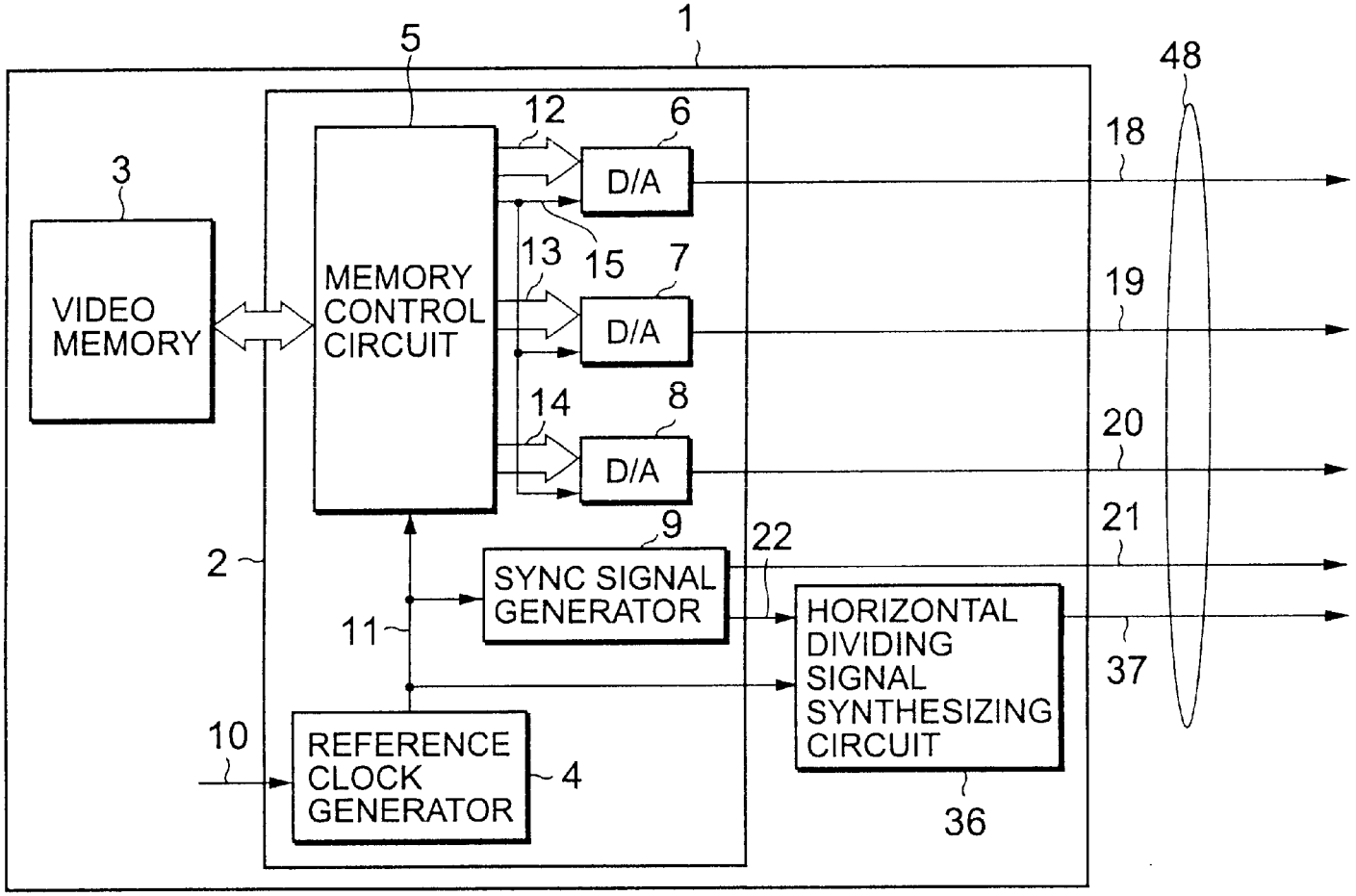
FIG. 9 is a view showing a part of a computer unit to which the present invention is applied, as second and seventh embodiments of the present invention.
Figure 10:
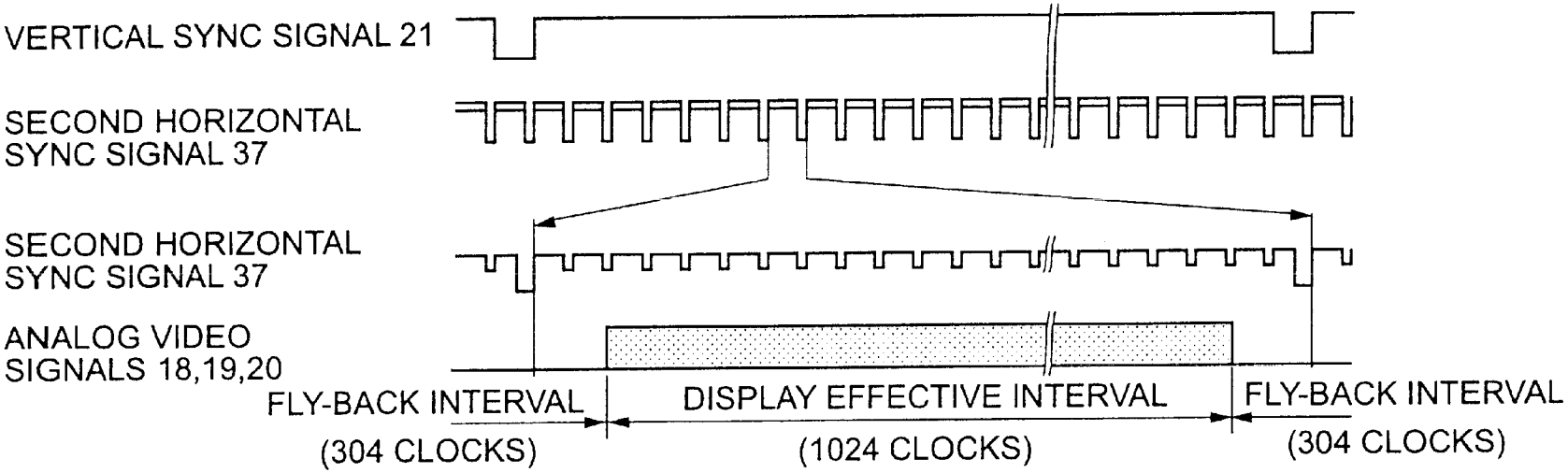
FIG. 10 is a view showing a second sync signal relating to the second embodiment of the present invention.

Next, second embodiment of the present invention will be described, referring to FIGS. 9 and 10. FIG. 9 shows an example of configuration of the graphic card 1 according to the present invention that superposes the horizontal dividing signal 42 to the horizontal sync signal 22, so as to output the superposed signal as the second horizontal sync signal 37. Here, the same components as in the figures of the first embodiment have the same reference numerals. The graphics card 1 is provided with the horizontal dividing signal synthesizing circuit 36, by means of which the graphics card 1 superposes the horizontal dividing signal 42 to the horizontal sync signal 22, so as to output it as the second horizontal sync signal 37. FIG. 10 shows how this is carried out. FIG. 10 is a view showing relationship between the vertical sync signal and the horizontal sync signal outputted by the graphics card 1. The vertical sync signal 21 is synchronized with the second horizontal sync signal 37. In the case that the display resolution is 1024×768 dots, a period of the vertical sync signal 21 equals to a period of 806 lines (=768 lines+38 fly-back intervals) of the second horizontal sync signal 37. On the other hand, as already stated in the first embodiment, the second horizontal sync signal 37 has the period of 1024 clocks of the display effective interval and 304 clocks of the fly-back interval, i.e., a period of 1328 clocks in total. In the display effective interval of 1024 clocks, effective video signals are outputted as respective analog video signals 18, 19, 20 from the D-A converters 6, 7, 8.

The second horizontal sync signal 37 has a voltage waveform obtained by superposing the horizontal dividing signal 42 to the horizontal sync signal 22 (FIG. 2), i.e., the voltage waveform such as shown in FIG. 4 as described in detail in the first embodiment. Namely, the second horizontal sync signal 37 is a TTL level logic signal of negative logic having amplitude of (5 v−0 v) in the timing of the horizontal sync signal, and is rectangular wave of micro voltage having amplitude of 0.2 v from 5 v in the timing of the horizontal dividing signal. The horizontal sync signal has such signal amplitude that crosses thresholds determining TTL logic, i.e., TTL logic threshold defined as "logical 1 is 2.0 v or more, and logical 0 is 0.8 v or less". On the other hand, the horizontal dividing signal has micro amplitude while maintaining the voltage of logical 1 of TTL (i.e., 2.0 v or more).

Thus described graphics card 1 can output the second horizontal sync signal 37, and, accordingly, by connecting the graphics card 1 to the liquid crystal display monitor 24 described in the first embodiment, it is possible to obtain flicker-less display as in the first embodiment. Further, the graphics card 1 of the present second embodiment can be connected to the conventional liquid crystal display monitor (such as the liquid crystal display monitor 24 shown in FIG. 18, for example) or to a CRT monitor, too, f or displaying. Namely, in the conventional liquid crystal display monitor or CRT monitor, the second horizontal sync signal 37 is the same as the conventional horizontal sync signal, when it is seen as a sync signal of TTL logic. Accordingly, the graphics card 1 of the present embodiment can have compatibility with the conventional liquid crystal display monitor and CRT monitor.

Figure 11:
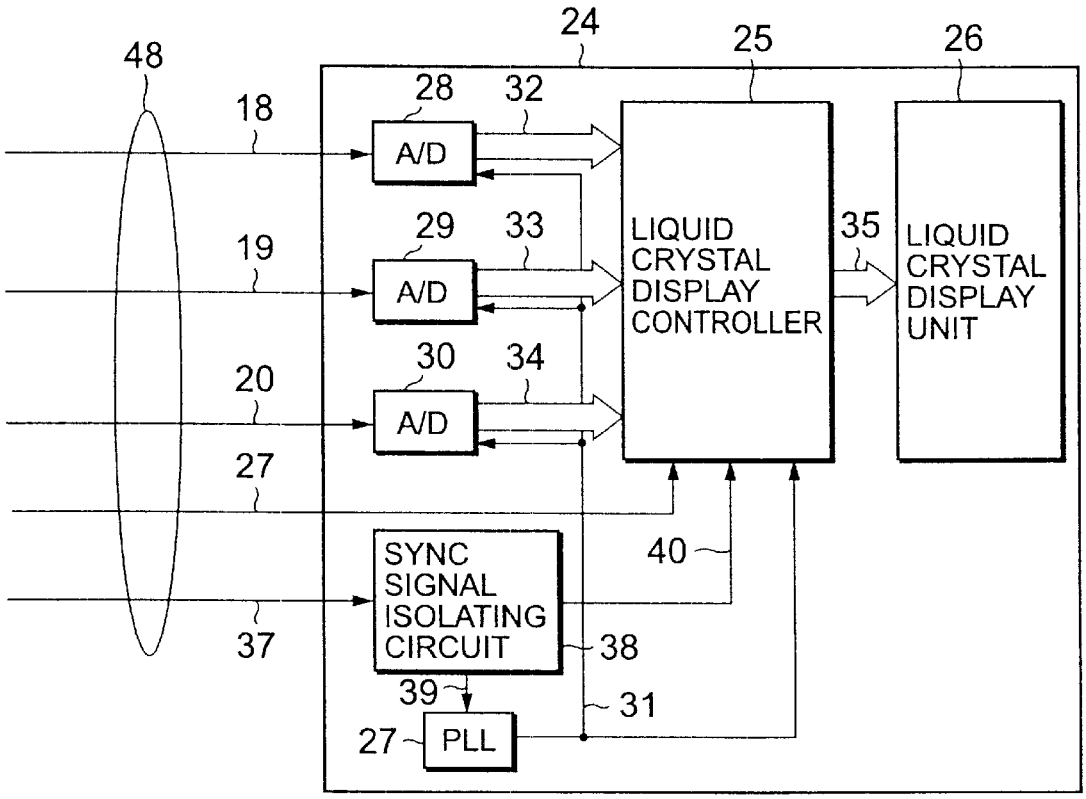
FIG. 11 is a block diagram showing a configuration of a liquid crystal monitor relating to third and eighth embodiments of the present invention.

Next, referring to FIG. 11, a third embodiment of the present invention will be described. FIG. 11 shows an example of a liquid crystal display monitor that displays video signal accompanying the second horizontal sync signal 37 on liquid crystal display unit. Here, the same components as in the figures of the first embodiment have the same reference numerals. The liquid crystal display monitor 24 of the third embodiment isolates the horizontal sync signal 40 and the horizontal dividing signal 39 from the second horizontal sync signal 37 by means of the sync signal isolating circuit 38, and, in particular, the isolated horizontal dividing signal 39 is inputted into the PLL 27 as its reference clock. Here, as the sync signal isolating circuit 38, the circuit shown in FIG. 5 is used similarly to the first embodiment.

From the horizontal dividing signal 39, the PLL 27 generates the conversion clock 31 to be used in the A-D converters 28, 29, 30 for A-D conversion of the analog video signals 18, 19, 20. Since this conversion clock 31 is generated from the horizontal dividing signal 39, as shown in the first embodiment, the PLL 27 follows phase shift etc. of the video signal to generate the conversion clock 31. Accordingly, the liquid crystal display monitor 24 can realize display suppressing its flicker caused by phase shift of the video signal.

Figure 18:
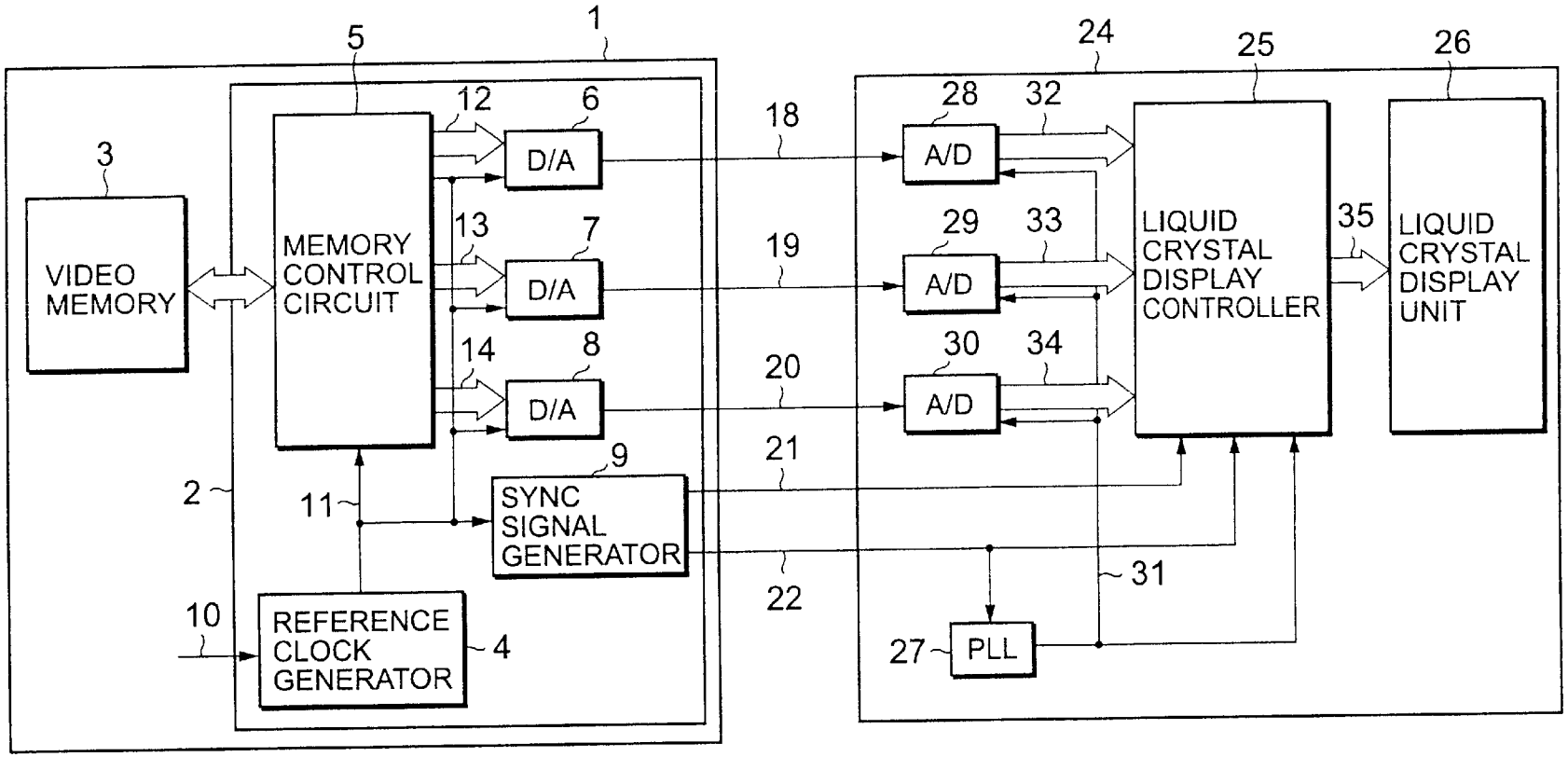
FIG. 18 is a block diagram showing a configuration of a conventional image display system.
Figure 19:
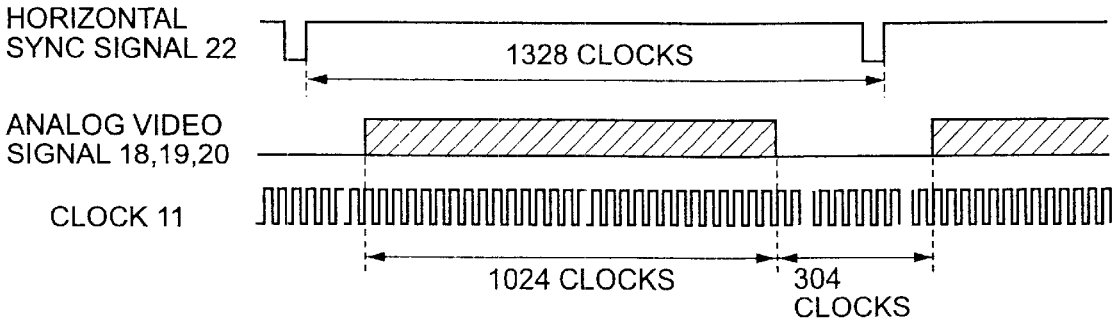
FIG. 19 is a view showing a relation between a conventional horizontal sync signal and a clock on the graphics card side.
Figure 20:
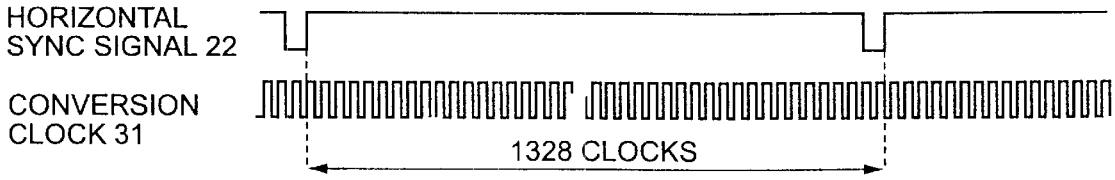
FIG. 20 is a view showing a relation between the conventional horizontal sync signal and a clock on the liquid crystal display monitor side.
Figure 21A:
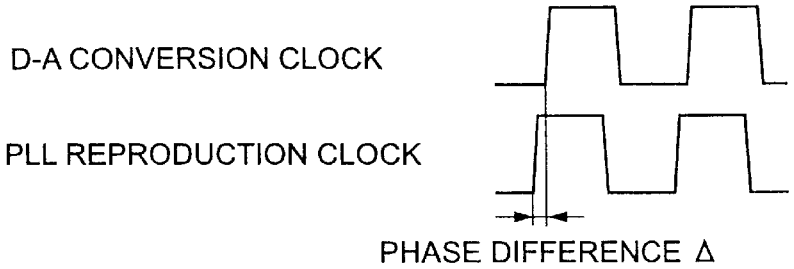
FIGS. 21A to 21D are views showing phase differences in the conventional clocks.
Figure 21B:
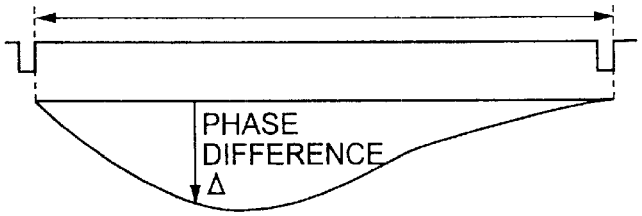
Figure 21C:
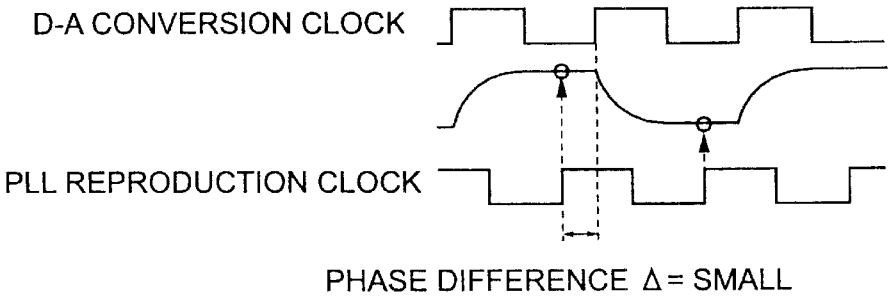
Figure 21D:
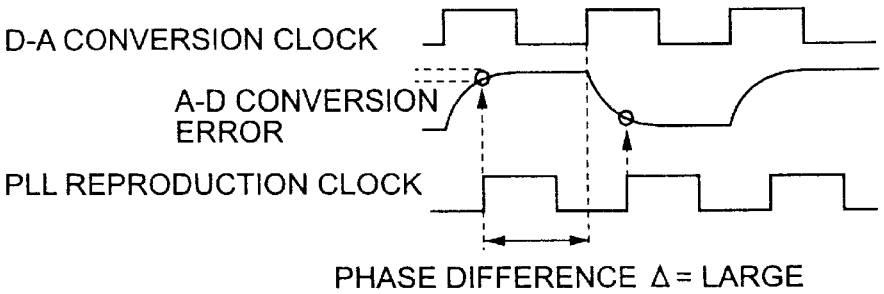

Furthermore, the liquid crystal display monitor 24 of the present third embodiment can be connected to the conventional graphics card (such as a graphics card 1 as shown in FIG. 18, for example) to obtain display similarly to the conventional monitor. In that case, the second horizontal sync signal 37 is the same signal as the conventional horizontal sync signal without having the horizontal dividing signal superposed. When such a sync signal is inputted as the second horizontal sync signal 37, the horizontal sync signal 40 is isolated and outputted from the sync signal isolating circuit 38, while no signal is outputted as the horizontal dividing signal 39. The comparator 47 of the sync signal isolating circuit 38 (FIG. 5) is operated while changing its comparison voltage from −0.1 v to −3 v as a threshold almost equal to TTL. By this, a signal equivalent to the horizontal sync signal is inputted to the PLL 27 from the sync signal isolating circuit 38. Further, by setting the PLL 27 to generate 1328 clocks from that equivalent signal, the PLL 27 can similarly generate the conversion clock 31. Thus, even if the conventional graphics card is used, it is possible to obtain display equal to the conventional case.

Next, a fourth embodiment will be described, referring to FIG. 1 and FIGS. 12–15. Here, the same components as in the first embodiment are given the same reference numerals. The fourth embodiment provides other examples of configuration for the horizontal dividing signal synthesizing circuit 36 and the sync signal isolating circuit 38.

Figure 12:
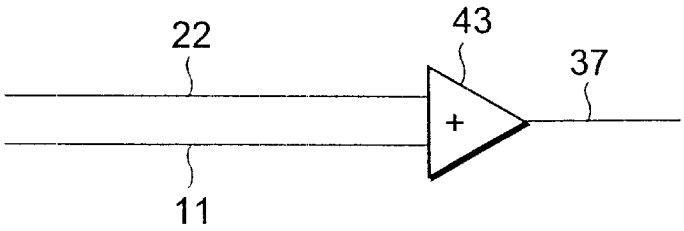
FIG. 12 is a block diagram showing a configuration of a horizontal dividing signal synthesizing circuit relating to the third embodiment of the present invention.
Figure 13:
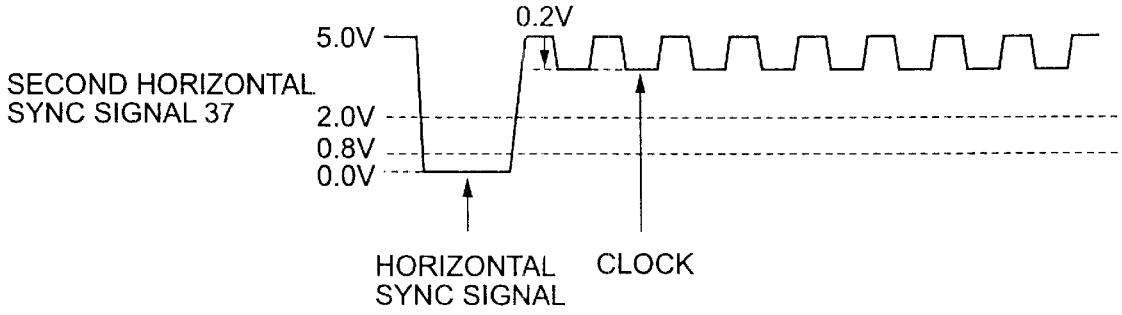
FIG. 13 is a view showing voltage levels of a second horizontal dividing signal relating to the third embodiment of the present invention.

FIG. 12 is a view showing a configuration of the horizontal dividing signal synthesizing circuit 36. The horizontal dividing signal synthesizing circuit 36 comprises constructed as an analog adder 43, and adds the horizontal sync signal 22 and the clock 11 in an analog manner to output the second horizontal sync signal 37. The detail of waveform of this second horizontal sync signal 37 is shown in FIG. 13. FIG. 13 shows the waveform of the second horizontal sync signal 37 obtained by superposing the clock 11 onto the horizontal sync signal 22. As shown in FIG. 13, the second horizontal sync signal 37 is a TTL level logic signal of negative logic having amplitude of from 5 v to 0 v in the timing of the horizontal sync signal 22, and is rectangular wave of micro voltage having amplitude of 0.2 v from 5 v in the timing of the clock 11. The horizontal sync signal has such amplitude that crosses thresholds determining TTL logic, i.e., TTL logic threshold defined as "logical 1 is 2.0 v or more, and logical 0 is 0.8 v or less". On the other hand, the clock has micro amplitude while maintaining the voltage of logical 1 of TTL (i.e., 2.0 v or more). Accordingly, in FIG. 13, seen from the viewpoint of TTL logic, the second horizontal sync signal 37 itself is simply the horizontal sync signal outputted from the adder 43, while, from the viewpoint of the micro signal level, it is seen as if the clock is outputted.

Figure 14:
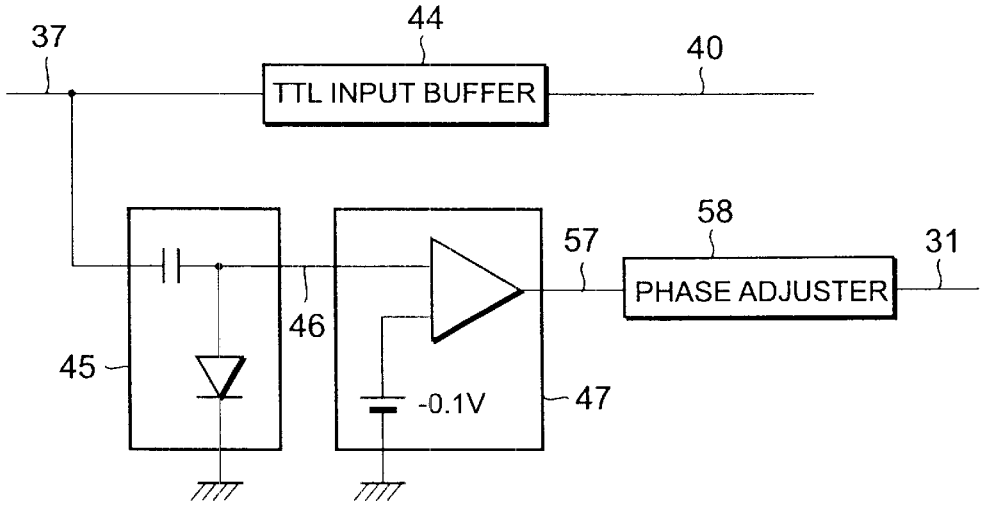
FIG. 14 is block diagram showing a configuration of a sync signal isolating circuit relating to the third embodiment of the present invention.
Figure 15:
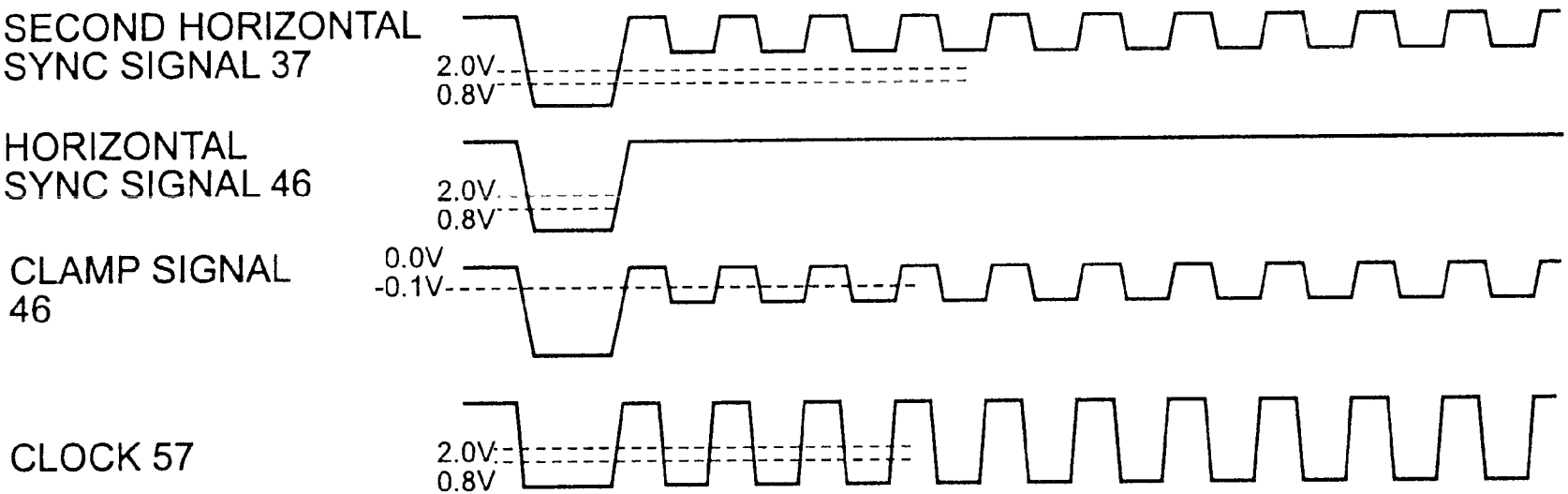
FIG. 15 is a view showing isolation of the clock relating to the third embodiment of the present invention.

Now, the method of displaying on the liquid crystal display monitor 24 using thus-described second horizontal sync signal 37 will be further described, referring to FIGS. 14, 15. First, the second horizontal sync signal 37 is inputted into the sync signal isolating circuit 38 of the liquid crystal display monitor 24. The sync signal isolating circuit 38 is a circuit for isolating the horizontal sync signal 40 and a clock 57 from the second horizontal sync signal 37. The sync signal isolating circuit 38 comprises a TTL input buffer 44, a clamping circuit 45, and a comparator 47. The second horizontal sync signal 37 is inputted into the TTL input buffer 44 and into the clamping circuit 45. The second horizontal sync signal 37 inputted into the TTL input buffer 44 is outputted as the horizontal sync signal 40, and the second horizontal sync signal 37 inputted into the clamping circuit 45 is outputted as clamp voltage 46. Further, the clamp voltage 46 is inputted into the comparator 47, and converted to the clock 57. A phase adjuster 58 adjusts the phase of the clock to output it as the conversion clock 31.

Referring to FIG. 15 too, more details will be described. The TTL input buffer 44 is a buffer circuit that has an input terminal for TTL logic and transfers input waveform to its output. The second horizontal sync signal 37 inputted into the TTL input buffer 44 is shaped in its waveform in accordance with the TTL logic threshold and outputted as the horizontal sync signal 40. On the other hand, the clamping circuit 45 is a circuit for converting reference voltage in such a manner that the highest voltage level (the level of logical 1) of the second horizontal sync signal 37 is made to be a reference level and this level is converted to 0 v. The clamping circuit 45 comprises a condenser and a diode. By inputting the second horizontal sync signal 37 into this clamping circuit 45, the clamp voltage 46 is generated. Next, the clamp voltage 46 is inputted into the comparator 47. The comparator 47 is a circuit that outputs TTL logical 1 when the inputted signal is −0.1 v or more, and outputs TTL logical 0 when the inputted signal is less than −0.1 v. The clamp voltage 46 is a voltage having the maximum of 0 v, and, by inputting the clamp voltage 46 into the comparator 47, it is possible to isolate it as the clock 57. The isolated clock 57 is inputted into the phase adjuster 58, which adjusts the clock 57 in its phase and outputs it as the conversion clock 31. This conversion clock 31 is used in the A-D converters 28, 29, 30 for converting the analog video signals 18, 19, 20 to the digital video signals 32, 33, 34. Thus, the analog video signals are converted to the digital video signals, and further converted to have timing for the liquid crystal display by the liquid crystal display controller 25, so as to display the image on the liquid crystal display unit 26.

As described above, when displaying the analog video signal on the liquid crystal display monitor, the clock for converting the analog video signals to the digital video signals is generated by using the clock superposed to the horizontal sync signal, and, by that, flicker owing to A-D conversion error caused by phase differenced between the clock and the analog video signals is scarcely generated, and it is possible to attain high quality display.

Figure 16:
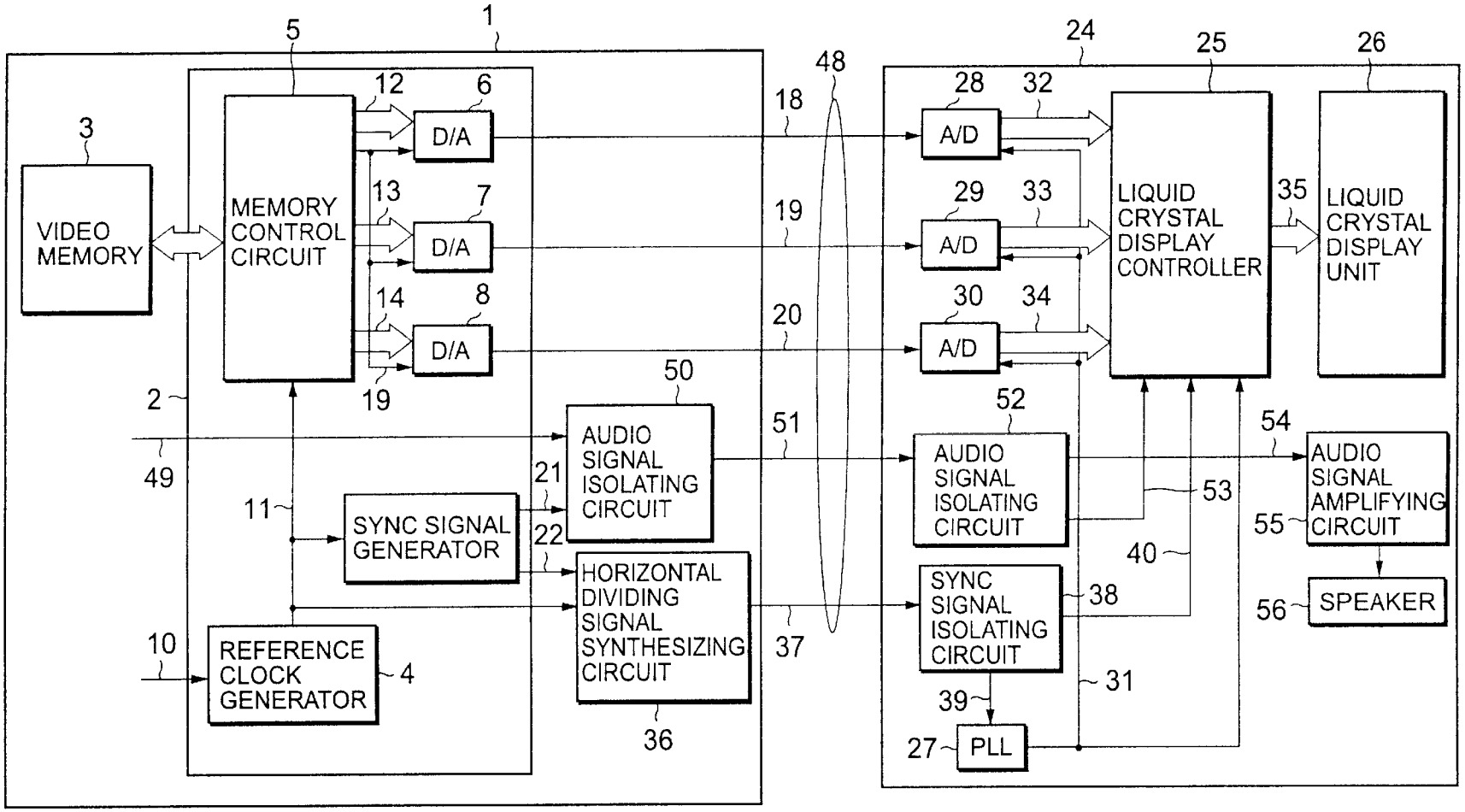
FIG. 16 is a block diagram showing a configuration of an image display system according to a fourth embodiment of the present invention.
Figure 17:
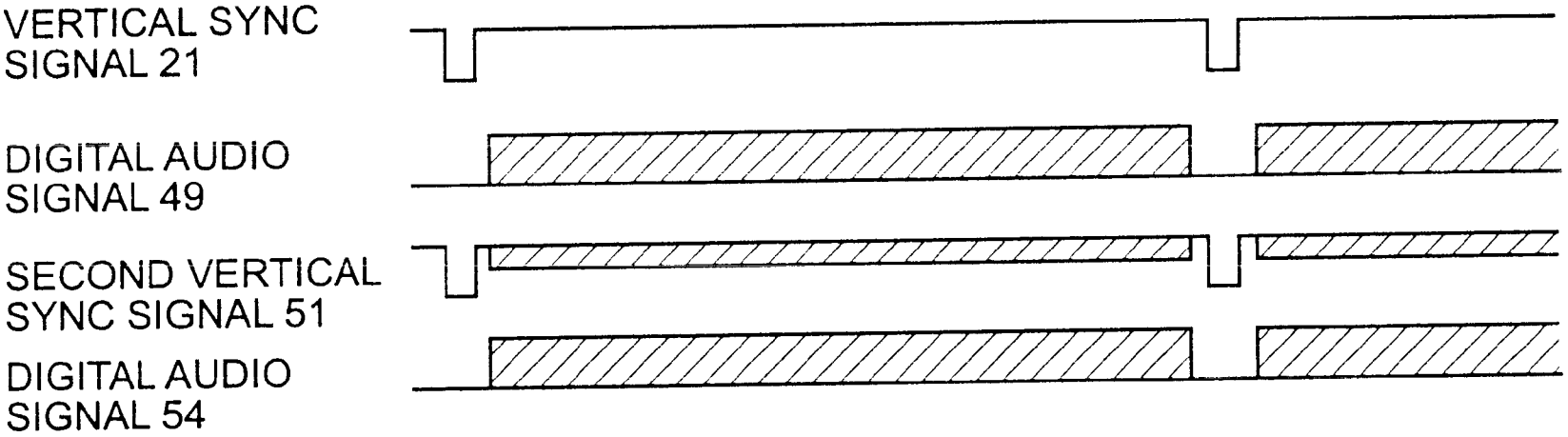
FIG. 17 is a view showing a second vertical sync signal relating to the ninth embodiment of the present invention.

Next, a fifth embodiment of the present invention will be described, referring to FIGS. 16, 17. The fifth embodiment is a case where a speaker is mounted on the liquid crystal display monitor 24, in addition to the graphics card 1 and the liquid crystal display monitor 24 of the first embodiment. In FIG. 16, the same components as in the first embodiment are given the same reference numerals. In FIG. 16, the reference numeral 49 refers to a digitized digital audio signal; 50 to an audio signal synthesizing circuit 51 for superposing the digital audio signal 49 to the vertical sync signal 21; 51 to a second vertical sync signal obtained by superposing in the audio signal synthesizing circuit 50; 52 to an audio signal isolating circuit for isolating the audio signal and the vertical sync signal from the second vertical sync signal 51; 53 to the vertical sync signal isolated in the audio signal isolating circuit 52; 54 to the digital audio signal isolated in the audio signal isolating circuit 52; 55 to an audio signal amplifying circuit for converting the digital audio signal 54 to audio signal and amplifying for driving the speaker; and 56 to a speaker for giving sound.

In FIG. 16, as in the first embodiment, the graphics card 1 employs a horizontal dividing signal synthesizing circuit 36, which superpose the horizontal dividing signal 42 to the horizontal sync signal 22 to output the second horizontal sync signal 37 and the liquid crystal display monitor 24 employs the sync signal isolating circuit 38 for isolating the horizontal sync signal 40 and the horizontal dividing signal 39 from the second horizontal sync signal 37, and employs the PLL 27 for generating the conversion clock 31 from the horizontal dividing signal 39. In this fifth embodiment, the digital audio signal 49 is superposed on the vertical sync signal 21, and, thereby, it is possible to drive the speaker 56 built in the liquid crystal display monitor 24 without providing particular cable for transmitting the audio signal. As shown in FIG. 17, the digital audio signal 49 is superposed to the vertical sync signal 21 in the audio signal synthesizing circuit 50, and is sent to the liquid crystal display monitor 24 as the second vertical sync signal 51. The second vertical sync signal 51 is, similarly to FIG. 4 of the first embodiment, a TTL level logic signal of negative logic having amplitude of (5 v–0 v) in the timing of the vertical sync signal, and has micro voltage having amplitude of 0.2 v from 5 v in the timing of the digital audio signal. The vertical sync signal has such signal amplitude that crosses thresholds determining TTL logic, i.e., TTL logic thresholds defined as "logical 1 is 2.0 v or more, and logical 0 is 0.8 v or less". On the other hand, the digital audio signal has micro amplitude while maintaining the voltage of logical 1 of TTL (i.e., 2.0 v or more). Accordingly, seen from the viewpoint of TTL logic, the second vertical sync signal 51 itself is simply the vertical sync signal outputted from the audio signal synthesizing circuit 50, while, from the viewpoint of the micro signal level, it is seen as if the clock is outputted.

For outputting sound from the speaker 56 of the liquid crystal display monitor 24 using thus-described second vertical sync signal 51, the second vertical sync signal 51 is inputted into the audio signal isolating circuit 52 of the liquid crystal display monitor 24. The audio signal isolating circuit 52 isolates the vertical sync signal 53 and the digital audio signal 54 from the second vertical sync signal 51. The audio signal isolating circuit 38 has a similar configuration as the sync signal dividing circuit of the first embodiment shown in FIG. 5, and comprises a TTL input buffer 44, a clamping circuit 45, and a comparator 47. The second vertical sync signal 51 is inputted into the TTL input buffer 44 and into the clamping circuit 45. The second vertical sync signal 51 inputted into the TTL buffer 44 is outputted as the vertical sync signal 53, and the second vertical sync signal 51 inputted into the clamping circuit 45 is outputted as clamp voltage 46. Further, the clamp voltage 46 is inputted into the comparator 47, and converted into the digital audio signal 54. The audio signal is amplified in the audio signal amplifying circuit 55 so as to drive the speaker 56.

In the fifth embodiment of the present invention, without providing particular cable for transmitting the audio signal to drive the speaker 56 built in the liquid crystal display monitor 24, it is possible to output the sound using the conventional video signal cable 48 only.

Here, the fifth embodiment of the present invention is not limited to the liquid crystal display monitor, and can be applied to such a monitor as CRT or the like.

Now, a sixth embodiment will be described.

FIG. 1 shows the configuration of the image display system relating to the present embodiment.

In the figure, the reference numeral 24 refers to the liquid crystal display monitor, and 1 to the graphics card mounted in a computer unit.

Here, the graphics card 1 comprises the video memory 3 and the graphics controller 2.

The graphics controller 2 comprises a memory control circuit 5 for controlling read and write of display data from and into the video memory 3, a reference clock generator 4 for generating, from a prescribed system clock 10, a clock 11 as reference for operation of the graphics controller 2, a sync signal generator 9 for generating, from the clock 11, a vertical sync signal 21 and a horizontal sync signal 22, D-A converters 6, 7, 8 for converting the display data read from the video memory 3 to analog video signals in synchronization with a clock 15 obtained by adjusting the phase of the clock 11, and a horizontal dividing signal synthesizing circuit 36 for generating a second horizontal sync signal 37 by superposing a horizontal dividing signal, which is obtained by dividing the frequency of the clock 11, on the horizontal sync signal 22. In such configuration, the graphics controller 2 sequentially reads the display data stored in the video memory 3, for each cycle of the clock 11, being synchronized with the vertical sync signal 21 and the horizontal sync signal 22, converts the data in the D-A converters 6, 7, 8, and outputs the data as the analog video signals 18, 19, 20, together with the vertical sync signal 21 and the second horizontal sync signal 37, to the liquid crystal display monitor 24.

On the other hand, the liquid crystal display monitor 24 comprises A-D converters 28, 29, 30 for converting the analog video signals 18, 19, 20 to the digital video signals 32, 33, 34, the PLL 27, the liquid crystal display controller 25, the liquid crystal display unit 26, and the sync signal isolating circuit 39.

In thus-described configuration, the sync signal isolating circuit 39 isolates separates the second horizontal sync signal 37 inputted from the graphics card 1 into the horizontal sync signal 40 and the horizontal dividing signal 39, and the PLL 27 generates the conversion clock 31 that is synchronized in phase with the horizontal dividing signal 39. Being synchronized with the conversion clock 31 generated by the PLL 27, sampling is carried out on the analog video signals 18, 19, 20 inputted from the graphics card 1, to convert them to the digital video signals 32, 33, 34. The liquid crystal display controller 25 displays the digital video signal 32, 33, 34 on the liquid crystal display unit 26, in synchronization with the horizontal sync signal 40 and the vertical sync signal 21 inputted from the graphics card 1.

As described above, the image display system according to the present embodiment is one obtained by adding the horizontal dividing signal synthesizing circuit 36 of the graphics card 1 and the sync signal isolating circuit 39 of the liquid crystal display monitor 24 to the conventional image display system shown in FIG. 18, so that the horizontal dividing signal obtained from the clock 11 by dividing its frequency is superposed on the horizontal sync signal and transmitted from the graphics card 1 to the liquid crystal display monitor 24 as the second horizontal sync signal 37, and, in the liquid crystal display monitor 24, the horizontal dividing signal is isolated from the horizontal sync signal 37, and the conversion clock 31 synchronized in phase with the horizontal dividing signal is generated.

FIG. 2 shows the configuration of the horizontal dividing signal synthesizing circuit 36 added to the graphics card 1 in the present embodiment.

As shown in the figure, the horizontal dividing signal synthesizing circuit 36 comprises the horizontal dividing signal generator 41 and the analog adder 43. The horizontal dividing signal generator 41 divides the frequency of the clock 11 to generates the horizontal dividing signal 42. Further, the horizontal dividing signal 42 outputted by the horizontal dividing signal generator 41 is synchronized in phase with the horizontal sync signal 22 and outputted.

Next, the horizontal dividing signal 42 is added to the horizontal sync signal 22 in the analog adder 43, and outputted as the second horizontal sync signal 37.

Now, there will be described the process of generating this second horizontal sync signal 37.

In FIG. 3, the clock 11 is a clock outputted by the reference clock generator 4, and, when the display resolution is 1024×768 dots and frame frequency is 70 Hz, it is a high speed clock of about 75 MHz. This clock 11 is adjusted in phase to become the conversion clock 15 used in the D-A converters 6, 7, 8 for D-A conversion to the analog video signals 18, 19, 20. The horizontal dividing signal generator 41 divides the frequency of this clock 11 to generate the horizontal dividing signal 42. As shown in FIG. 3, the horizontal dividing signal 42 is obtained by dividing the frequency of the clock 11 by eight, and, further, is synchronized in phase with the horizontal sync signal 22. Here, the horizontal sync signal 22 has a period of 1024 clocks of the display effective interval and 304 clocks of the fly-back interval, i.e., 1328 clocks in total. Accordingly, the horizontal dividing signal 42 divides the horizontal sync signal 22 into 166 parts.

Such horizontal dividing signal 42 and the horizontal sync signal 22 are synthesized in the adder 43, to be outputted as the second horizontal sync signal 37. The second horizontal sync signal 37 is a signal obtained by adding the horizontal sync signal 22 and the weighted horizontal dividing signal 42 in an analog manner.

As a result of this addition, the second horizontal sync signal 37 shown in FIG. 4 is obtained.

This second horizontal sync signal 37 is equivalent to the horizontal sync signal 22 as a TTL logic signal. In accordance with the voltage thresholds of TTL logic, voltage value of the second horizontal sync signal is 2.0 v or more in the interval that the horizontal sync signal 22 is logical 1, and 0.8 v or less in the interval that the horizontal sync signal 22 is logical 0.

At the same time, in the interval that the horizontal sync signal 22 is logical 1, the second horizontal sync signal 37 takes the voltage values corresponding to the logical values of the horizontal dividing signal 42 within the range of the voltage level of logical 1 of TTL logic. In other words, the voltage value of the second horizontal sync signal 37 is 5.0 v in the interval that the horizontal dividing signal 42 is logical 1, and 4.8 v in the interval that the horizontal dividing signal 42 is logical 0.

Accordingly, as a TTL logic signal, the second horizontal sync signal 37 itself shown in FIG. 4 is simply the horizontal sync signal 22 that is outputted from the adder 43. However, as a micro level signal, the second horizontal sync signal 37 periodically outputs, at every 8th clock, micro pulse indicating the horizontal dividing signal.

Figure 22:
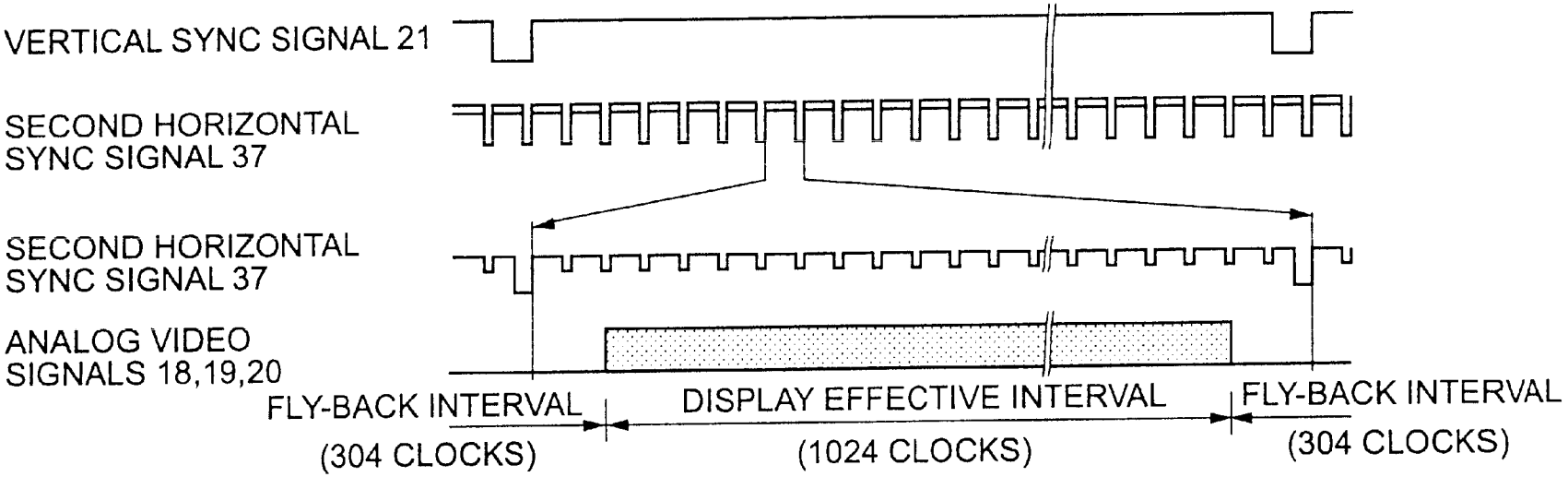
FIG. 22 is a view showing a second horizontal sync signal relating to the sixth embodiment of the present invention.

Here, in the case of display (blanking) resolution of 1024×768 dots and 806 lines (=768 scan lines+38 retrace lines), relationship between the vertical sync signal 21 and the second horizontal sync signal 37 outputted by the graphics card 1 becomes as shown in FIG. 22.

The vertical sync signal 21 is synchronized with the second horizontal sync signal 37, and the period of the vertical sync signal 21 equals to the periods of the second horizontal sync signal 37 corresponding to 806 lines (=768 lines+38 retrace lines). On the other hand, the period of the second horizontal sync signal 37 comprises 1024 clocks of the display effective interval and 304 clocks of the fly-back interval, i.e., 1328 clocks in total. In the display effective interval of 1024 clocks, effective video signals are outputted from the D-A converters 6, 7, 8 as respective analog video signals 18, 19, 20.

The present embodiment adds the sync signal isolating circuit 38 to the liquid crystal display monitor 24, and the configuration of the sync signal isolating circuit 38 is shown in FIG. 5.

As shown in the figure, the sync signal isolating circuit 38 comprises a TTL input buffer 44, a clamping circuit 45, and a comparator 47. The second horizontal sync signal 37 is inputted into the TTL input buffer 44 and into the clamping circuit 45. The second horizontal sync signal 37 inputted into the TTL input buffer 44 is outputted as the horizontal sync signal 40, and the second horizontal sync signal 37 inputted into the clamping circuit 45 is outputted as the clamp voltage 46.

The clamp voltage 46 is inputted into the comparator 47, converted to the horizontal dividing signal 39, and inputted into the PLL 27 as its reference clock.

Here, the TTL input buffer 44 is a buffer circuit that has an input terminal for TTL logic and transfers input waveform to its output. As shown in FIG. 6, the second horizontal sync signal 37 inputted into the TTL input buffer 44 is shaped in its waveform in accordance with the TTL logic thresholds and outputted as the horizontal sync signal 40.

Further, the clamping circuit 45 is a circuit for converting the voltage of the second horizontal sync signal 37 to such a voltage that the highest voltage level (the level of logical 1) of the second horizontal sync signal 37 is converted to 0 v, and comprises a condenser and a diode. By inputting the second horizontal sync signal 37 into this clamping circuit 45, the clamp voltage 46 is generated. Then, the clamp voltage 46 is inputted into the comparator 47. The comparator 47 is a circuit that outputs TTL logical 1 when the inputted signal is −0.1 v or more, and outputs TTL logical 0 when the inputted signal is less than −0.1 v. The clamp voltage 46 is a voltage having the maximum value of 0 v, and, by inputting this into the comparator 47, horizontal dividing signal 39 can be isolated. The isolated horizontal dividing signal 39 is inputted into the PLL 27 as its reference clock.

As shown in FIG. 7, the PLL 27 generates a clock having a period of one eighth of the period of the horizontal dividing signal 39, being synchronized in phase with the horizontal dividing signal 39 as the conversion clock 31. This conversion clock 31 is a clock used in the A-D converters 28, 29, 30 for converting the analog video signals 18, 19, 20 to the digital video signals 32, 33, 34. Then, the liquid crystal display controller 25 converts the video signal to have the timing for the liquid crystal display, so as to display the image on the liquid crystal display unit 26.

According to thus-described configuration, as shown in FIG. 8, the phase difference δ between the clock 11 and the conversion clock 31 is corrected for each period of the horizontal dividing signal 39, i.e., at every 8th clock, and, accordingly, flicker of the display owing to A-D conversion error is greatly reduced. For example, in the case that the horizontal dividing signal divides one horizontal interval into 166 parts as described above, the phase difference δ is highly compressed to 1/166 on average in comparison with the conventional case, and flicker of the display owing to the A-D conversion error caused by the phase difference δ is scarcely generated.

Further, the graphics card 1 having the above-described configuration can be applied to the conventional liquid crystal display monitor (for example, the liquid crystal display monitor shown in FIG. 8 according to the conventional technique) and CRT monitor. Namely, in the conventional liquid crystal display monitor or CRT monitor, the second horizontal sync signal 37 can be treated as an ordinary horizontal sync signal of TTL logic without having the superposed horizontal dividing signal. Accordingly, the graphics card 1 of the present embodiment can be used for realizing display on the conventional liquid crystal display monitor or CRT monitor.

Further, the liquid crystal display monitor 24 of the present embodiment may be provided with an arrangement that can switch the frequency dividing ratio of the PLL 27 or the comparison voltage of the comparator 47 of the sync signal isolating circuit 39. As a consequence, the liquid crystal display monitor 24 of the present embodiment can be connected to and used with the conventional graphics card (for example, the graphics card of the conventional technique shown in FIG. 18).

Namely, in a case of connection to the conventional graphics card, the second horizontal sync signal 37 is the ordinary horizontal sync signal. When the comparison voltage of the comparator 47 of the sync signal isolating circuit 39 is switched from −0.1 v to −3 v so as to be a threshold almost equal to TTL, a signal equivalent to the horizontal sync signal is inputted from the sync signal isolating circuit 39 to the PLL 27 as its reference clock. Then, by setting the PLL 27 to generate 1328 clocks in the period of the reference clock, the conversion clock 31 similar to the conventional case is generated. Accordingly, this makes it possible to realize display equal to the conventional case, being connected to the conventional graphics card.

Here, in the present embodiment, the horizontal dividing signal is superposed to the horizontal sync signal. Instead, the horizontal dividing signal may be superposed on the vertical sync signal.

In the following, the seventh embodiment of the present invention will be described.

The present seventh embodiment is application of the above sixth embodiment to an image display system, in which, as a sync signal, a composite sync signal obtained by combining the horizontal sync signal and the vertical sync signal is transmitted between the graphics card 1 and the liquid crystal display monitor 24.

Figure 23:
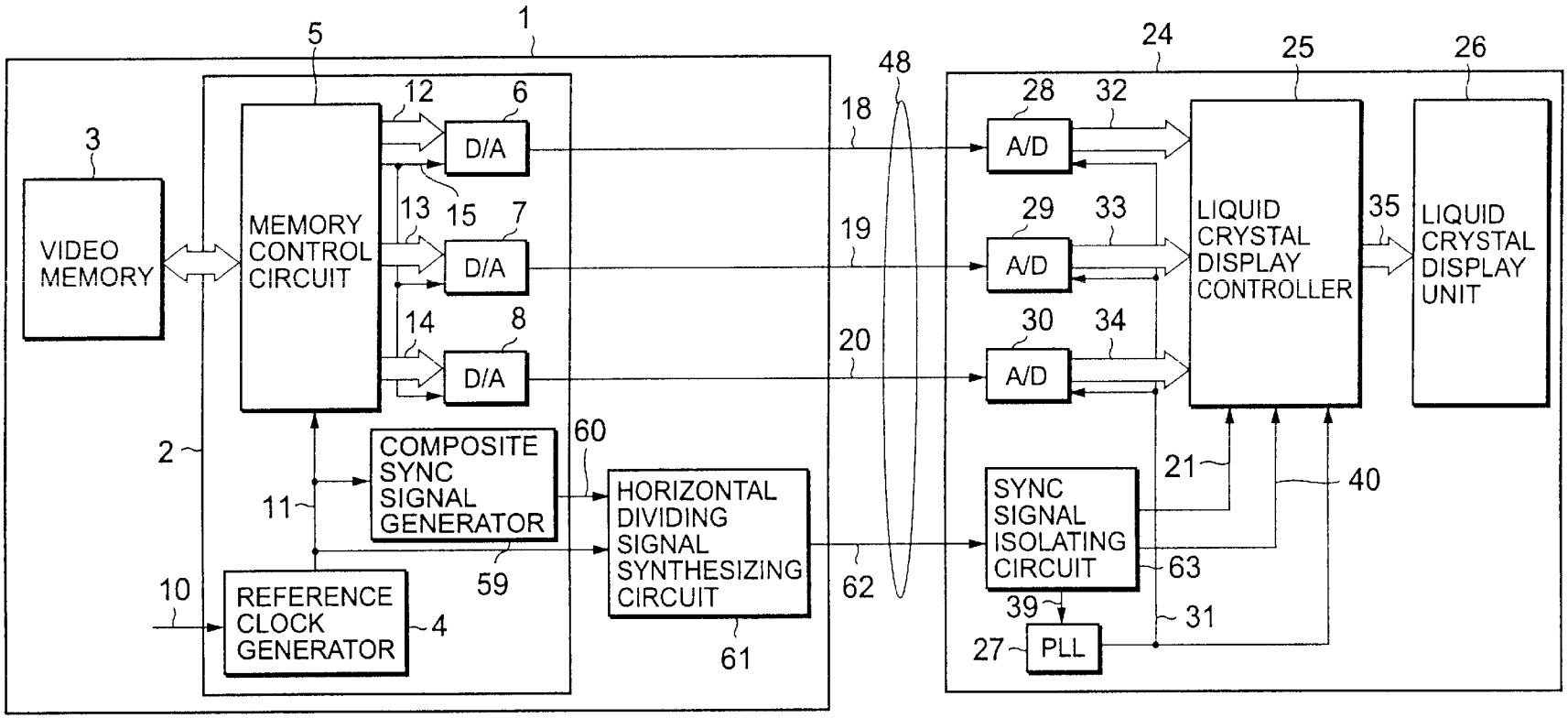
FIG. 23 is a block diagram showing a configuration of an image display system according to the seventh embodiment of the present invention.

FIG. 23 shows a configuration of the image display system of the present embodiment.

As shown in the figure, the image display system of the present embodiment differs from the sixth embodiment shown in FIG. 1 in the following points. Namely, instead of the sync signal generator 9 of the graphics card 1 in the sixth embodiment, there is provided a composite sync signal generator 59 that generates the composite sync signal 60 as combination of the horizontal sync signal and the vertical sync signal. The composite sync signal 60 instead of the horizontal sync signal 22 is inputted to the horizontal dividing signal synthesizing circuit 61. Instead of the second horizontal sync signal 37, a second composite sync signal 62 which is obtained by superposing the horizontal dividing signal to the composite sync signal 60 is outputted to the liquid crystal display monitor 24. Further, construction and operation of the sync signal isolating circuit 63 of the liquid crystal display monitor 24 are different from the above-described sixth embodiment.

Figure 39:
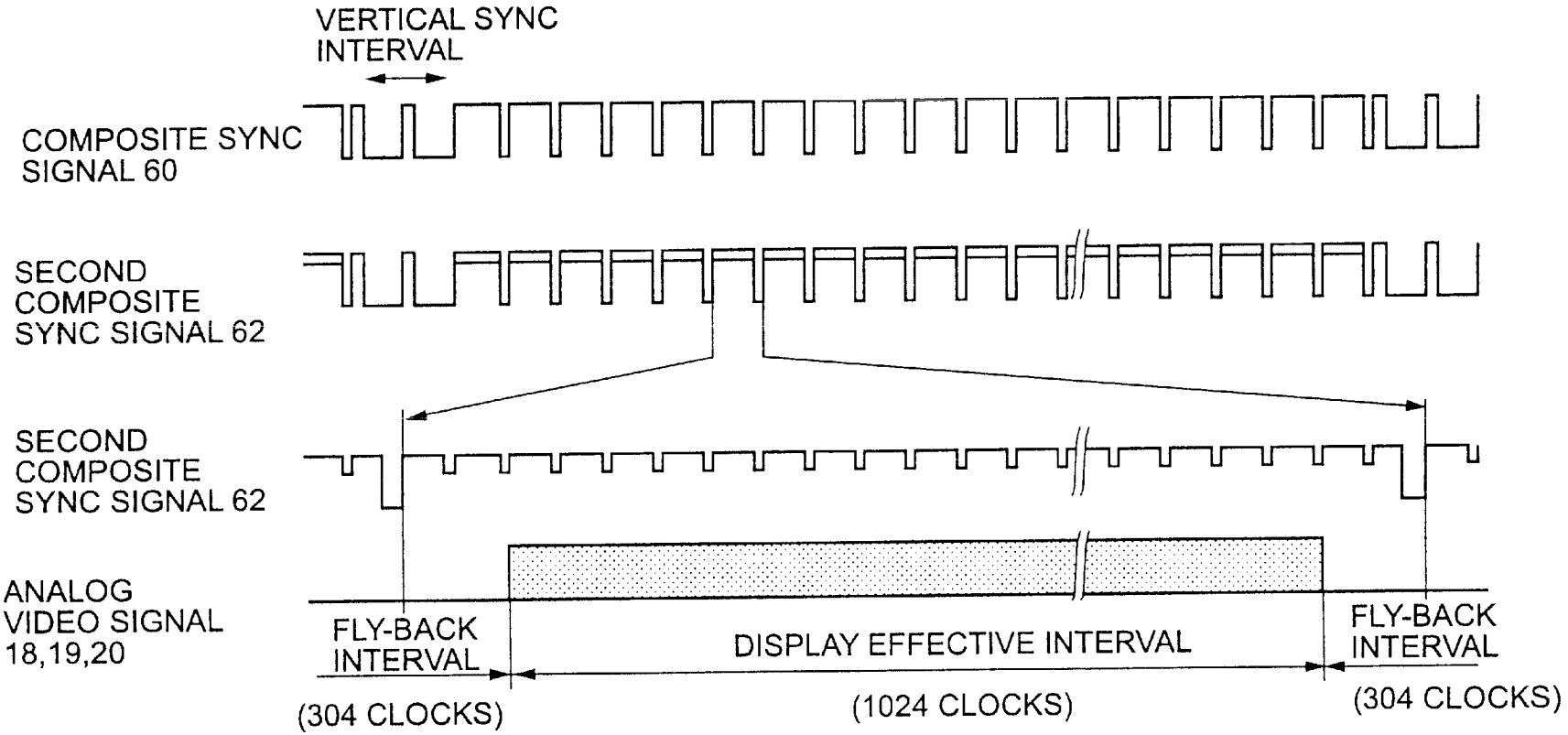
FIG. 39 is a view showing a second composite sync signal relating to the seventh embodiment of the present invention.

As shown in FIG. 39, the composite sync signal generator 59 generates the composite sync signal 60 from the clock 11. The composite sync signal 60 is a composite sync signal obtained by converting the logic of the ordinary horizontal sync signal in the vertical sync interval. The horizontal dividing signal synthesizing circuit 61 has the same construction as the horizontal dividing signal synthesizing circuit 36 of the sixth embodiment shown in FIG. 2. The horizontal dividing signal synthesizing circuit 61 superposes the horizontal dividing signal, which is obtained by dividing the frequency of the clock 11 by 8 and being synchronized in phase with the horizontal sync signal, on the composite sync signal 60, to generate the second composite sync signal 62. As shown in FIG. 11, similar to the above sixth embodiment, the second composite sync signal 62 is equivalent to the composite sync signal 60 as a TTL logic signal. In accordance with the voltage thresholds of TTL logic, the voltage value of the second composite sync signal 62 is 2.0 v or more in the interval that the composite sync signal 60 is logical 1, and 0.8 v or less in the interval that the composite sync signal 60 is logical 0. Further, at the same time, in the interval that the composite sync signal 60 is logical 1, the second composite sync signal 62 takes the voltage values corresponding to the logical values of the horizontal dividing signal within the range of the voltage level of logical 1 of TTL logic. In other words, the voltage value of the second composite sync signal 62 is 5.0 v in the interval that the horizontal dividing signal is logical 1, and 4.8 v in the interval that the horizontal dividing signal is logical 0.

Figure 40:
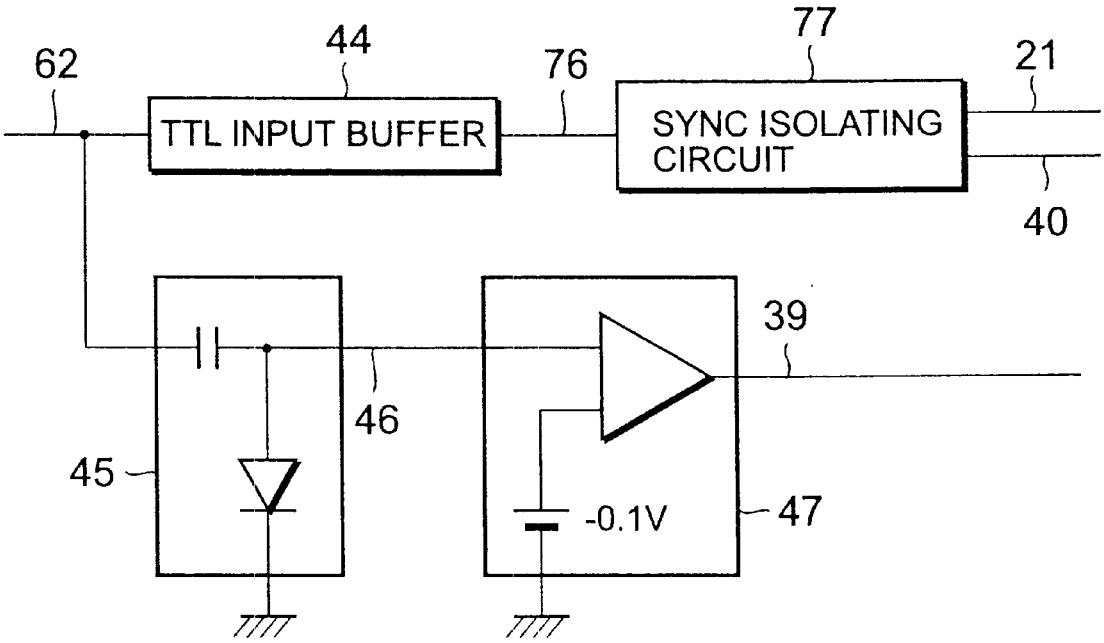
FIG. 40 is a block diagram showing a configuration of a sync signal isolating circuit relating to the seventh embodiment of the present invention.

Next, FIG. 40 shows a configuration of the sync signal isolating circuit 63 of the present seventh embodiment.

As shown in the figure, the sync signal isolating circuit 63 comprises a TTL input buffer 44, a SYNC isolating circuit 77, a clamping circuit 45, and a comparator 47. The second composite sync signal 62 is inputted into the TTL input buffer 44 and into the clamping circuit 45.

Figure 24:
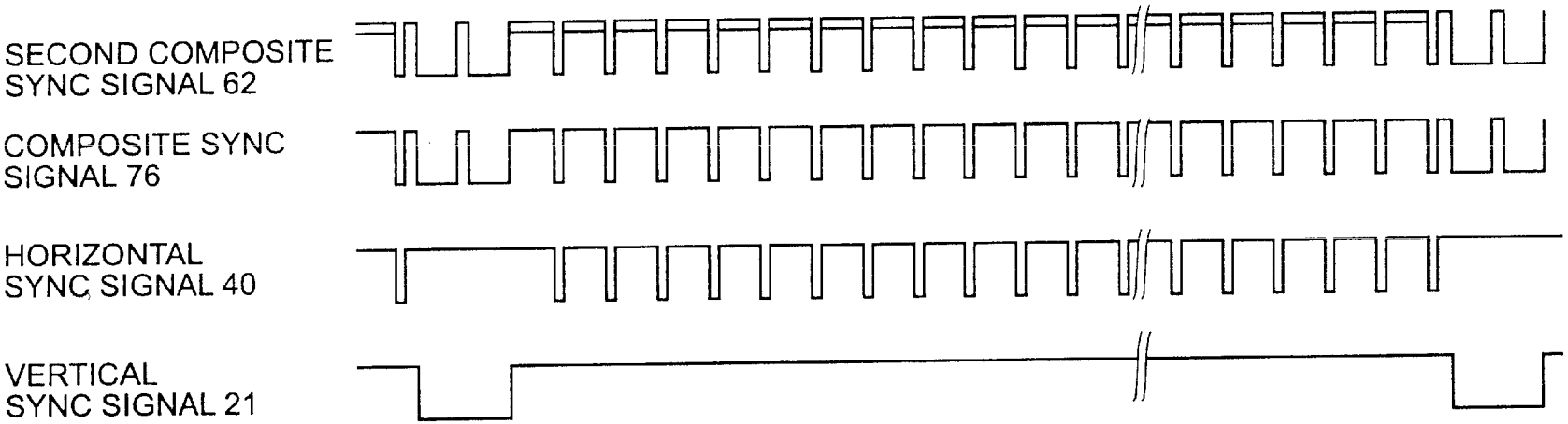
FIG. 24 is a view showing isolation of the sync signal relating to the seventh embodiment of the present invention.

As shown in FIG. 24, the second composite sync signal 62 inputted into the TTL input buffer 44 is shaped in its waveform in accordance with the TTL logic thresholds and outputted as the composite sync signal 76. The composite sync signal 76 is inputted into the SYNC isolating circuit 77, and separated into the vertical sync signal 21 and the horizontal sync signal 40 to be outputted.

Figure 25:
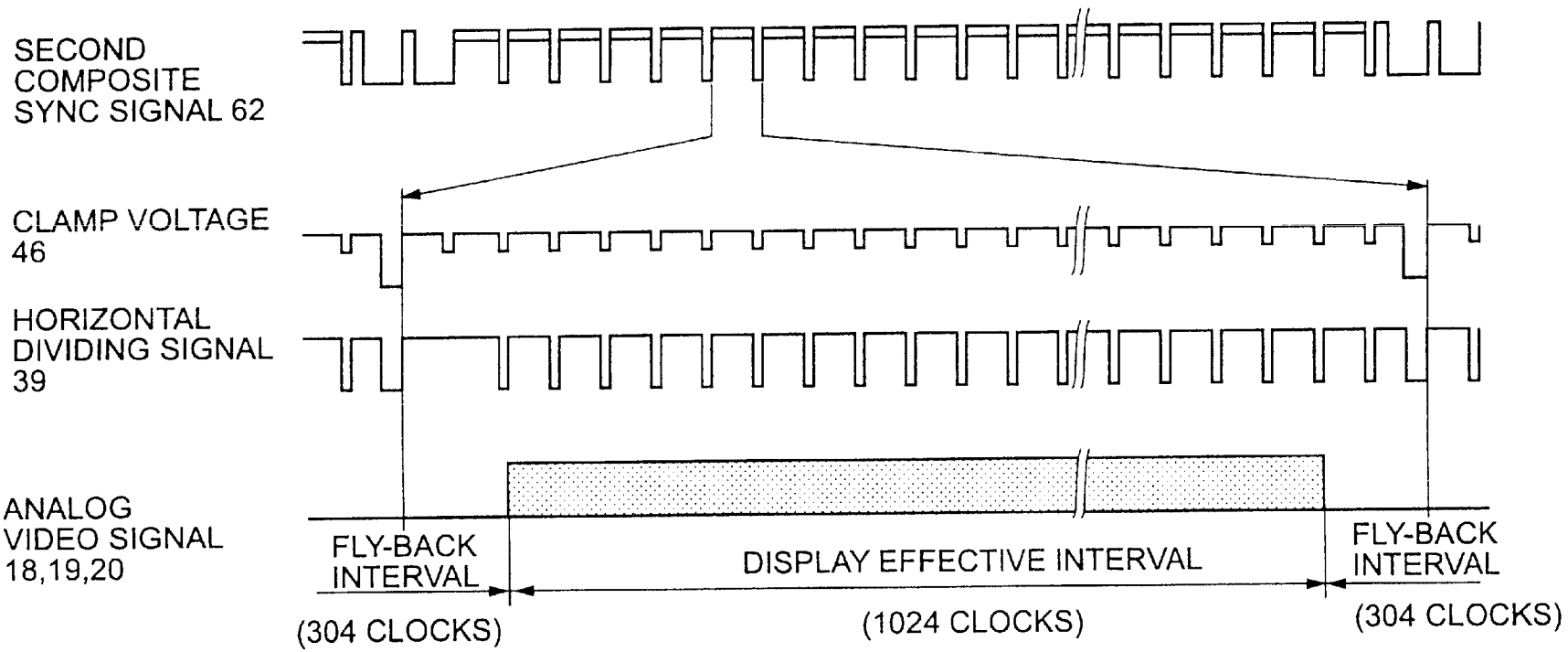
FIG. 25 is a view showing isolation of the horizontal dividing signal relating to the seventh embodiment of the present invention.

On the other hand, as shown in FIG. 25, the second composite sync signal 62 inputted into the clamping circuit 45 is converted into the clamp voltage 46 having the maximum voltage of 0 v, as in the above sixth embodiment, and inputted into the comparator 47. The comparator 47 outputs the horizontal dividing signal 39 to PLL 27, the horizontal dividing signal 39 being TTL logical 1 when the inputted signal is −0.1 v or more, and TTL logical 0 when the inputted signal is less than −0.1 v.

As in the sixth embodiment, the PLL 27 generates the conversion clock 31 having a period of one eighth of the horizontal dividing signal 39. This conversion clock 31 is used in the A-D converters 28, 29, 30 for converting the analog video signals 18, 19, 20 to the digital video signals 32, 33, 34. Then, the liquid crystal controller 25 converts the video signals to have the timing for the liquid crystal display, so as to display the image on the liquid crystal display unit 26.

According to the above-described construction, even in the case that the composite sync signal 60 is used as a sync signal, it is possible to mostly prevent flicker owing to the A-D conversion error as in the above sixth embodiment. Further, similar to the above sixth embodiment, the graphics card 1 of the above-described construction can be applied to the conventional liquid crystal display monitor or CRT monitor that receives composite sync signal as its input. Further, the liquid crystal display monitor 24 of the present embodiment may be provided with an arrangement that can switch the frequency dividing ratio of the PLL 27 or the comparison voltage of the comparator 47 of the sync signal isolating circuit 39. As a consequence, the liquid crystal display monitor 24 of the present embodiment can be connected to and used with the conventional graphics card that outputs composite sync signal.

In the above-described sixth and seventh embodiments, the period of the horizontal dividing signal is one obtained by dividing the frequency of the clock 11 by 8. However, the horizontal dividing signal may have other period synchronized in phase with the clock 11. Or, the clock 11 itself may be used as the horizontal dividing signal.

Now, an eighth embodiment of the present invention will be described.

Figure 26:
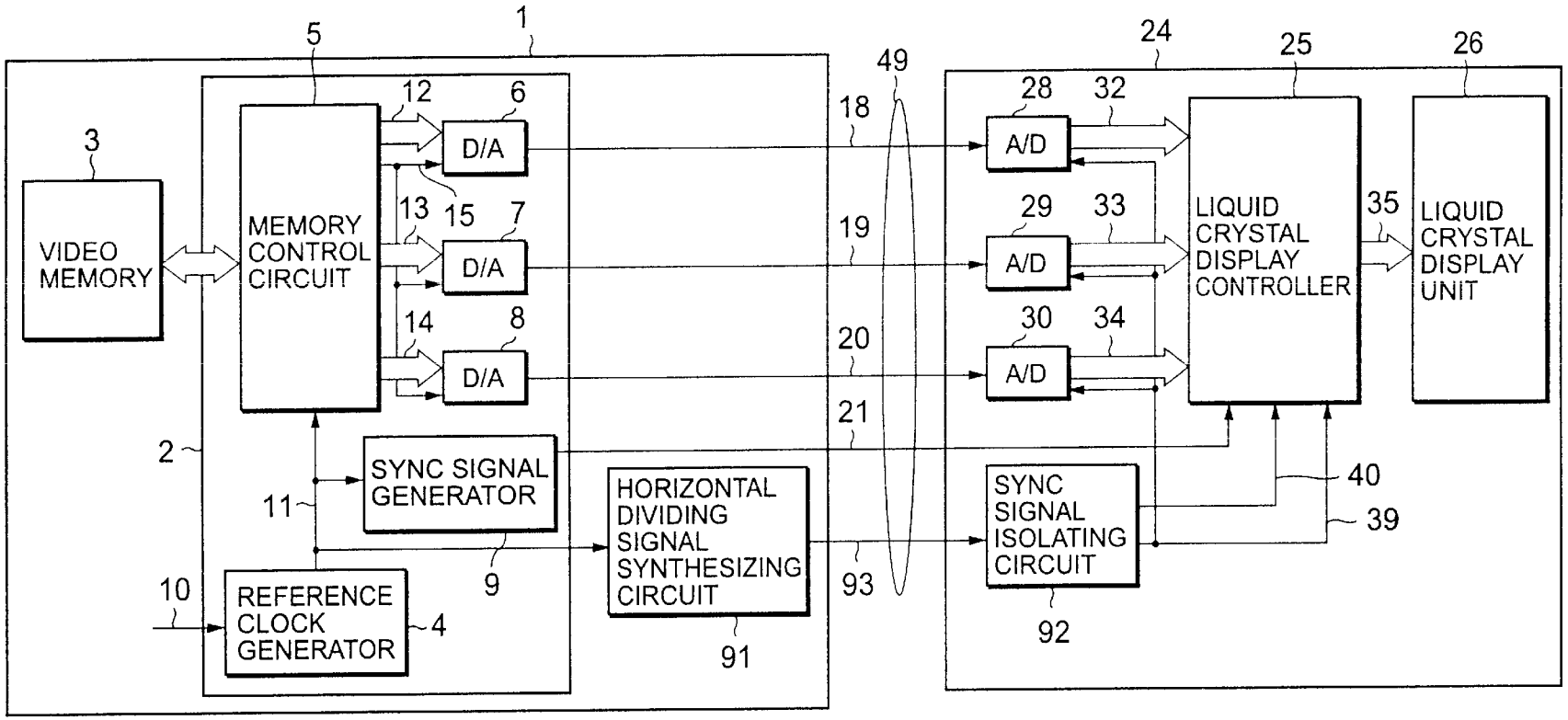
FIG. 26 is a block diagram showing a configuration of an image display system according to the third and eighth embodiment of the present invention.

FIG. 26 shows a configuration of an image display system of the present eighth embodiment.

As shown in the figure, the image display system of the present eighth embodiment has following construction. Namely, the PLL 27 is removed from the liquid crystal display monitor 24 of the image display system of the above sixth embodiment shown in FIG. 1. Instead of the PLL 27, the sync signal isolating circuit 92 generates the conversion clock 31. Further, construction and operation of the horizontal dividing signal synthesizing circuit 91 and the sync signal isolating circuit 92 are different from the above sixth embodiment.

Figure 41:
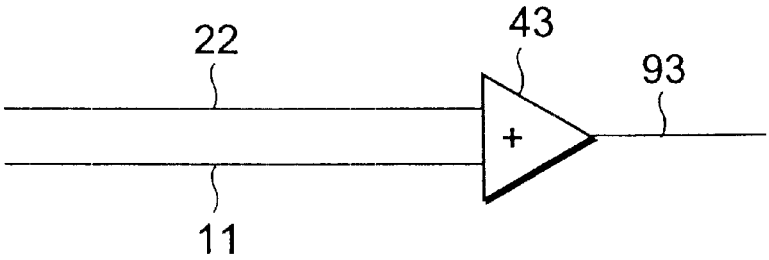
FIG. 41 is a block diagram showing a configuration of a horizontal dividing signal synthesizing circuit relating to the eighth embodiment of the present invention.

First, FIG. 41 shows the configuration of the signal synthesizing circuit 36 of the present eighth embodiment.

As shown in the figure, the horizontal dividing signal synthesizing circuit 91 of the present embodiment consists of the analog adder 43, and adds the horizontal sync signal 22 and the clock 11 in an analog manner to output the second horizontal sync signal 93.

Figure 42:
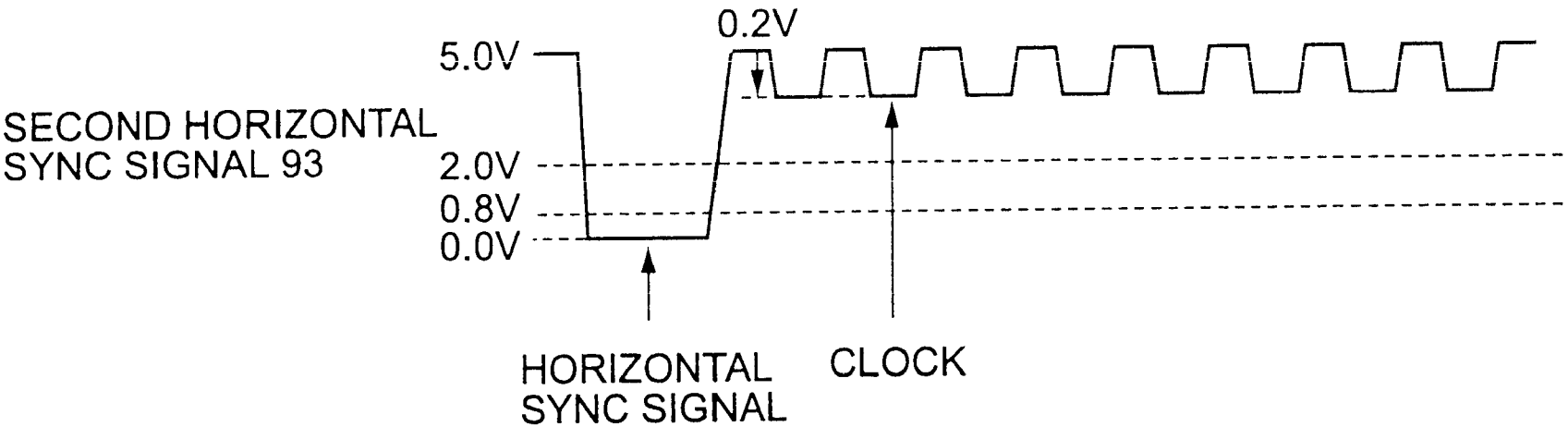
FIG. 42 is a block diagram showing voltage levels of a second horizontal dividing signal relating to the eighth embodiment of the present invention.

As shown in FIG. 42, this second horizontal sync signal 93 is obtained by superposing the clock 11 on the horizontal sync signal 22, and equivalent to the horizontal sync signal 22 as a TTL logic signal. In accordance with the voltage thresholds of the TTL logic, the voltage value of the second horizontal sync signal 93 is 2.0 v or more in the interval that the horizontal sync signal 22 is logical 1, and 0.8 v or less in the interval that the horizontal sync signal 22 is logical 0. Further, at the same time, in the interval that the horizontal sync signal 22 is logical 1, the second horizontal sync signal 93 takes the voltage values corresponding to the logical values of the clock 11 within the range of the voltage level of logical 1 of TTL logic. In other words, the voltage value of the second horizontal sync signal 93 is 5.0 v in the interval that the clock 11 is logical 1, and 4.8 v in the interval that the clock 11 is logical 0.

Figure 43:
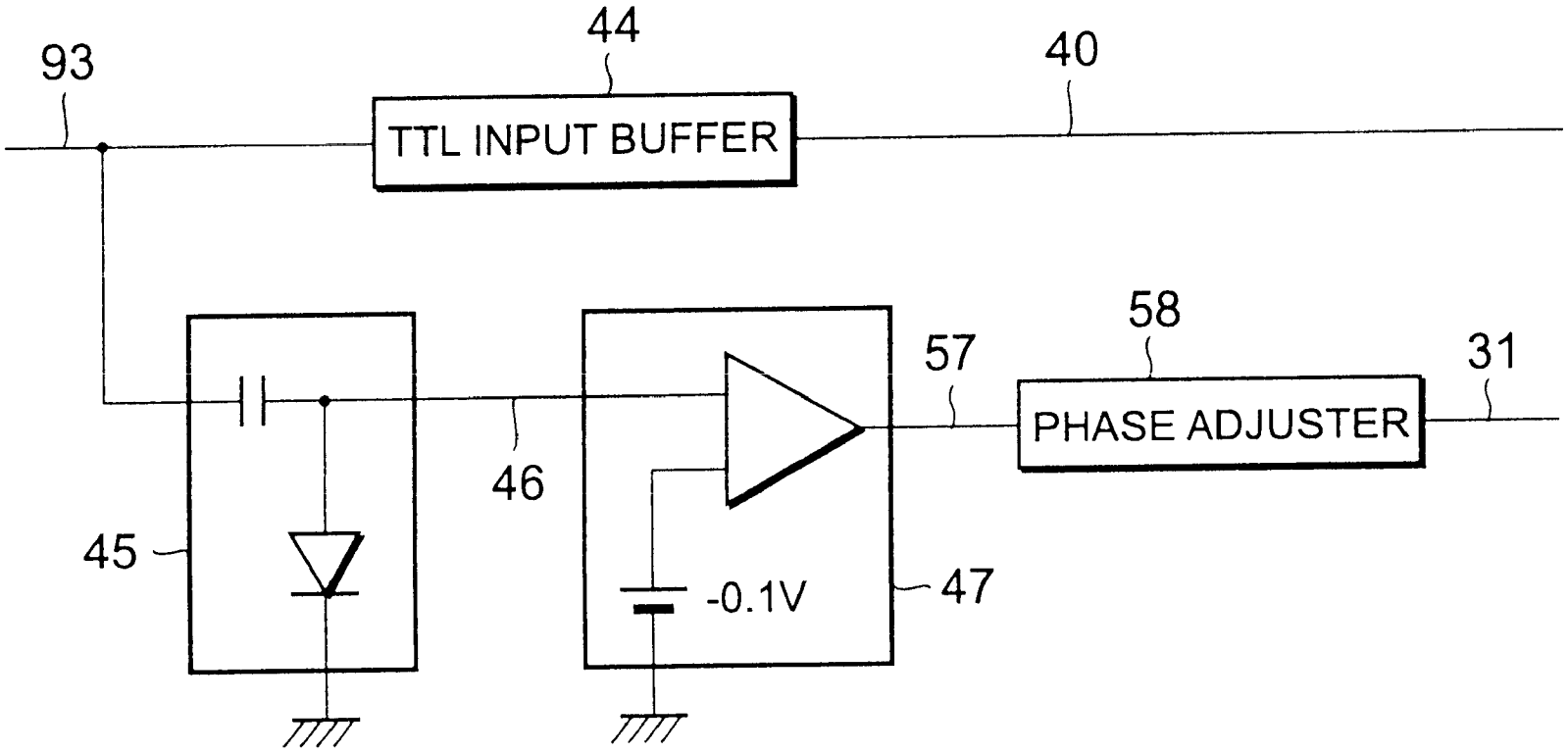
FIG. 43 is a block diagram showing a configuration of a sync signal dividing circuit relating to the eighth embodiment of the present invention.

Next, FIG. 43 shows a configuration of the sync signal isolating circuit 92 of the present eighth embodiment.

As shown in the figure, the sync signal isolating circuit 92 comprises a TTL input buffer 44, a clamping circuit 45, a comparator 47, and a phase adjuster 58.

Figure 44:
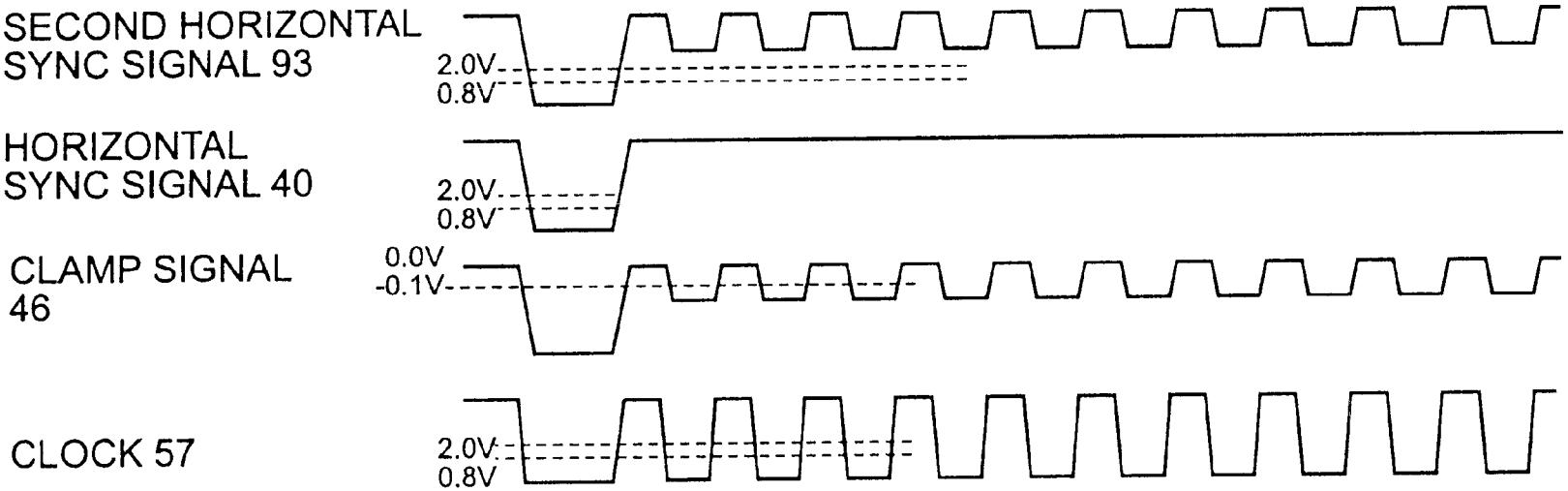
FIG. 44 is a view showing isolation of a clock relating to the eighth embodiment of the present invention.

The second horizontal sync signal 93 is inputted into the TTL input buffer 44 and into the clamping circuit 45. As shown in FIG. 44, the second horizontal sync signal 93 inputted into the TTL input buffer 44 is shaped in its waveform in accordance with the TTL logic thresholds and outputted as the horizontal sync signal 40. Further, the second horizontal sync signal 93 inputted into the clamping circuit 45 is converted into a clamp voltage 46 having the maximum voltage of 0 v as in the above sixth embodiment, and, then, the clamp voltage 46 is inputted into the comparator 47. The comparator 47 outputs a clock 57 that takes TTL logical 1 when the inputted signal is −0.1 v or more, and TTL logical 0 when the inputted signal is less than −0.1 v. The clock 57 is adjusted in its phase in suitable degree in the phase adjuster 58, and outputted as the conversion clock 31. This conversion clock 31 is used in the A-D converters 28, 29, 30 for converting the analog video signals 18, 19, 20 to the digital video signal 32, 33, 34. Thus, the analog video signals are converted to the digital video signal, and, further, the liquid crystal display controller 25 converts them to have the timing of the liquid crystal display, so as to display the image on the liquid crystal display unit 26. Here, in the timing of the horizontal sync signal, the conversion clock 31 is different from the clock 11. However, in this timing, effective video signal is not inputted, and therefore, no problem occurs.

According to thus-described present eighth embodiment, when displaying analog video signals on the liquid crystal display monitor, a clock for converting the analog video signals to the digital signals is generated from the clock superposed to the horizontal sync signal, so that the phase difference δ between the clock and the analog video signals is excluded, and it is possible to prevent flicker of the display owing to the A-D conversion error caused by this phase difference δ.

Further, the graphics card 1 of the above-described construction can be applied to the conventional liquid crystal display monitor or CRT monitor that receives the composite sync signal as its input. Further, the liquid crystal display monitor 24 of the present embodiment may be provided with an arrangement that can switch the dividing ratio of the PLL 27 or the comparison voltage of the comparator 47 of the sync signal isolating circuit 39. As a consequence, the liquid crystal display monitor 24 of the present embodiment can be connected to and used with the conventional graphics card that outputs the composite sync signal.

Here, the present eighth embodiment has been described in the case that the clock 11 is superposed to the horizontal sync signal, to be transmitted as sync signal from the graphics card 1 to the liquid crystal display monitor 24. However, the clock 11 may be transmitted being superposed on the vertical sync signal, or it may be transmitted being superposed on the composite sync signal as in the above seventh embodiment.

In the following, a ninth embodiment of the present invention will be described.

Figure 45:
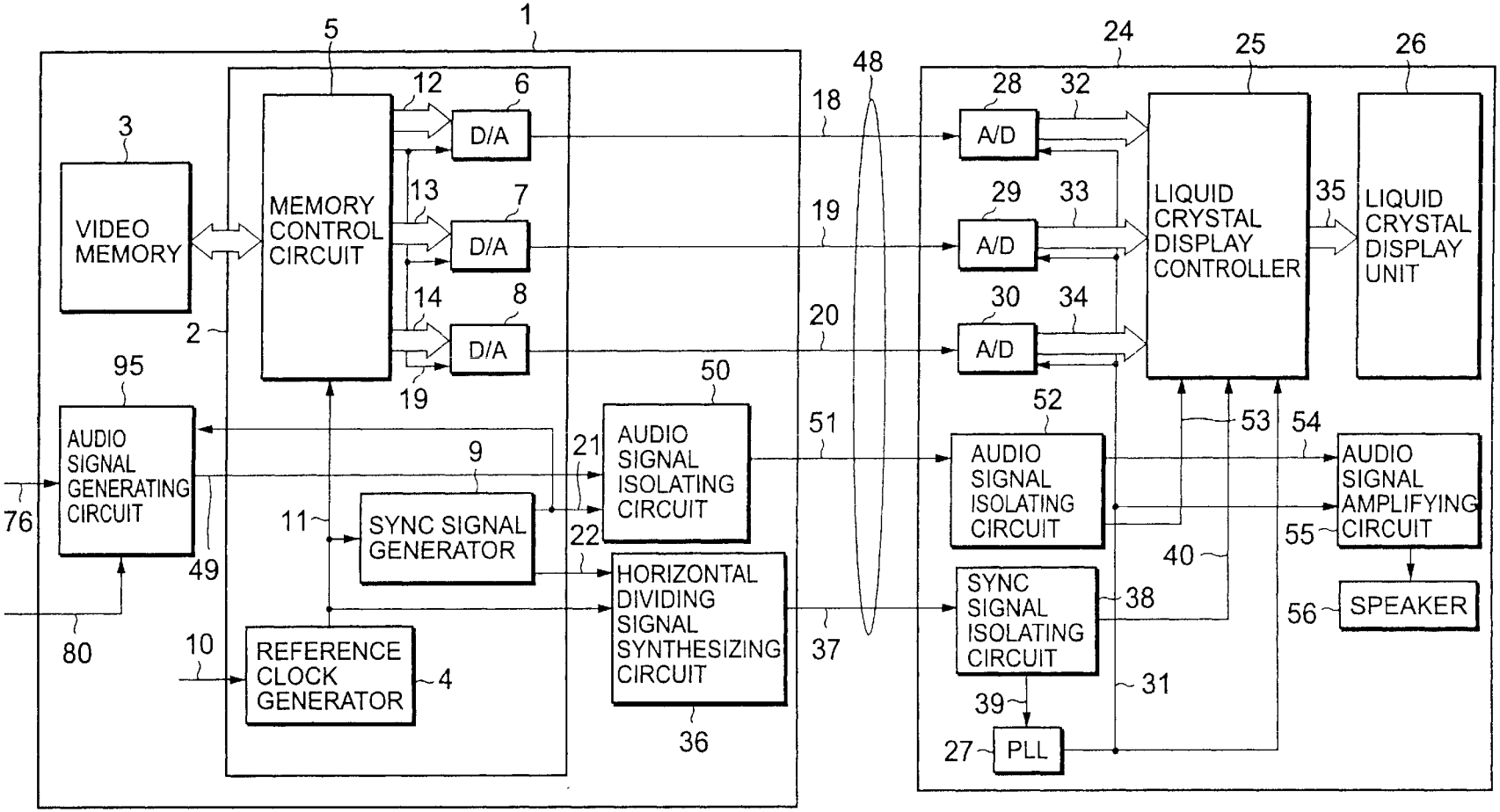
FIG. 45 is a block diagram showing a configuration of an image display system relating to the ninth embodiment of the present invention.

FIG. 45 shows a configuration of the image display system of the present embodiment.

As shown in the figure, the image display system of the present embodiment is similar to the image display system of the sixth embodiment shown in FIG. 1, except that an audio signal generating circuit 95 and an audio signal synthesizing circuit 50 are added to the graphics card 1, and an audio signal isolating circuit 52, an audio signal reproduction circuit 55, and a speaker 56 are added to the liquid crystal display monitor 24.

According to the present embodiment, in the graphics card 1, the audio signal generating circuit 95 generates digital audio signal by encoding generated analog audio signal. The audio signal synthesizing circuit 21 superposes the digital audio signal to the vertical sync signal 21 to output them as a second vertical sync signal 51. On the other hand, in the liquid crystal display monitor 24, the audio signal isolating circuit 52 isolates the vertical sync signal 53 and the digital audio signal 54 from the second vertical sync signal 51. The audio signal reproduction circuit 55 reproduces the analog audio signal from the isolated digital audio signal 54, to output the sound from the speaker 56.

By this arrangement, according to the present ninth embodiment, it is possible to transmit the audio signal from the graphics card 1 to the liquid crystal display monitor 24 without requiring a transmission line for audio signal transmission.

In the following, details will be described.

Figure 27:
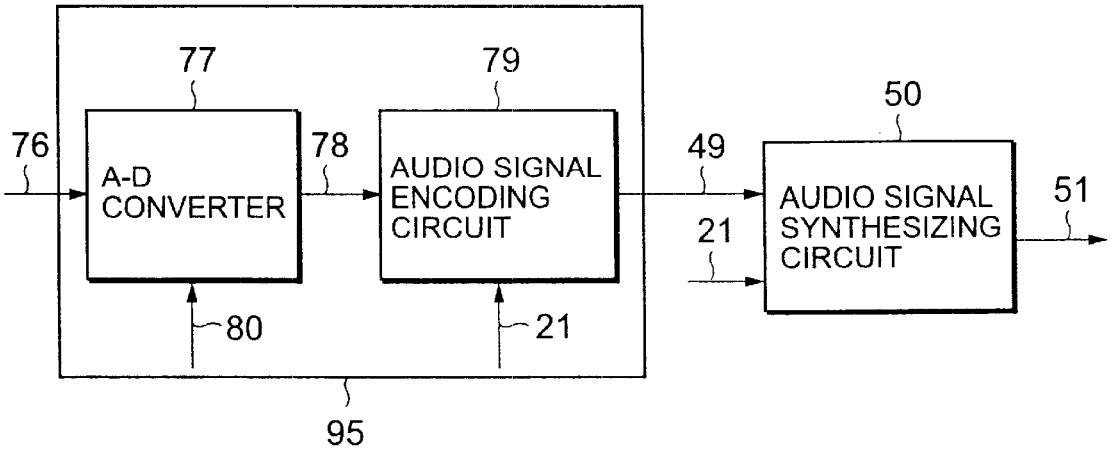
FIG. 27 is a block diagram showing a configuration of an audio signal generating circuit according to the ninth embodiment of the present invention.

FIG. 27 shows a configuration of the audio signal generating circuit 95.

As shown in the figure, the audio signal generating circuit 95 comprises an A-D converter 77 and an audio signal encoding circuit 79.

Figure 28:
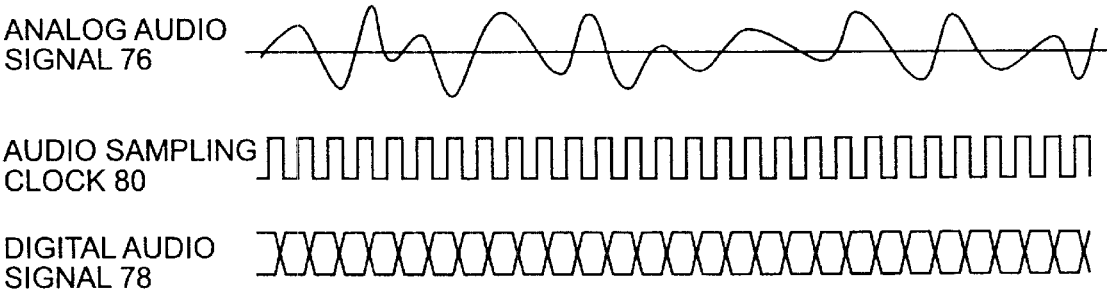
FIG. 28 is a view showing D-A conversion relating to the ninth embodiment of the present invention.

As shown in FIG. 28, the A-D converter 77 samples the inputted analog audio signal 76 with a prescribed audio sampling clock 80, converts to a digital audio signal 78, and outputs it to the audio signal encoding circuit 79. Here, to realize high quality reproduction of the audio frequency band 16–20 kHz, the frequency of the sampling clock is made to be more than 40 kHz, i.e., twice as many as 20 kHz, the maximum frequency of the audio frequency band, and bit number of the digital audio signal is 16 bits or more. However, such sampling clock frequency and the bit number of the digital audio signal may be suitably decided depending on required sound quality.

The audio signal encoding circuit 79 encodes the digital signal 78, in synchronization with the vertical sync signal 21 generated by the sync signal generator 9.

Figure 29:
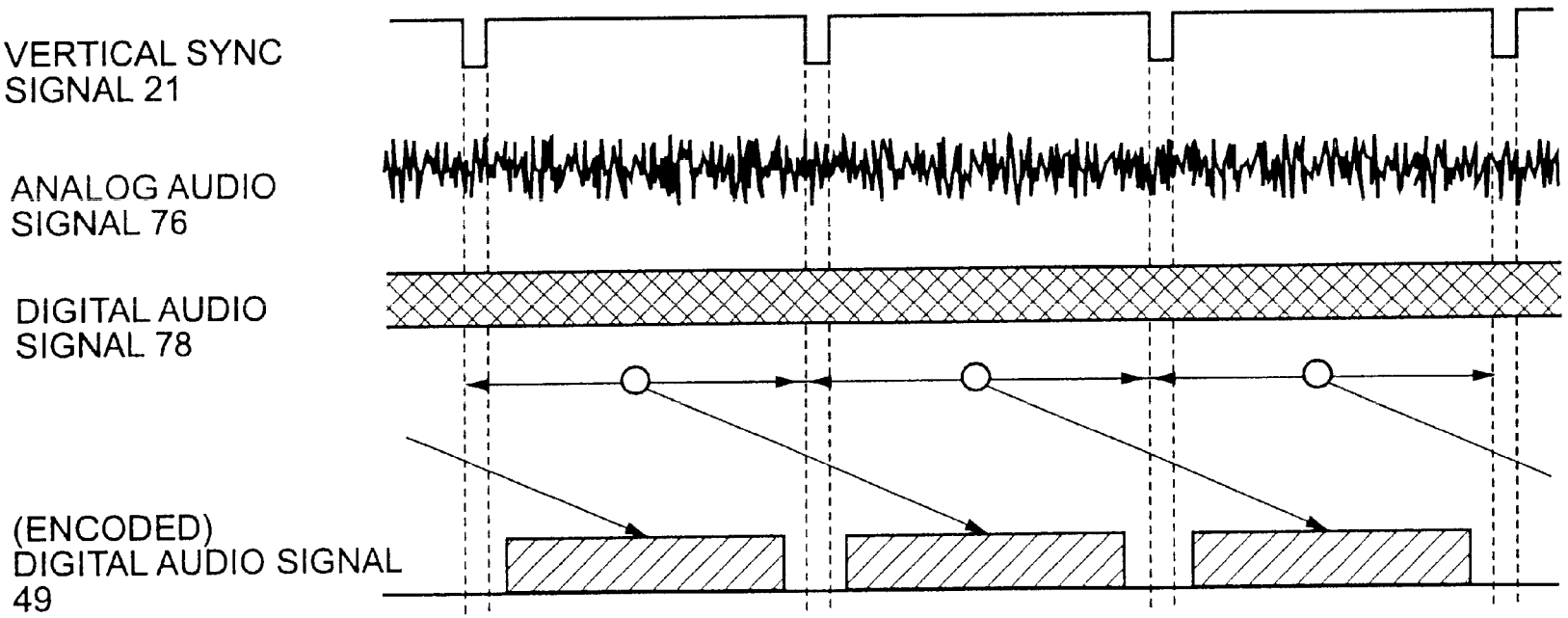
FIG. 29 is a view showing generation of the digital audio signal relating to the ninth embodiment of the present invention.

Namely, as shown in FIG. 29, encoding is carried out for each unit of digital audio signal 78, the unit being defined as the signal 78 corresponding to each vertical interval expressed by the vertical sync signal 21. The digital audio signal 78 inputted in each vertical interval is encoded to obtain serialized digital audio signal 49 as encoded data. The serialized digital audio signal 49 is outputted to the audio signal synthesizing circuit 50 in the vertical interval next to the interval in which the digital audio signal 78 is inputted. When the digital audio signal 49 is outputted in that vertical interval, it is outputted in a prescribed interval defined in a interval in which the vertical sync signal 21 is not of Low-voltage within that vertical interval. This prescribed interval is defined in relation to the interval in which the vertical sync signal 21 has Low-voltage within that vertical interval.

Here, the output interval for outputting the digital audio signal 49 encoded by the audio signal encoding circuit 79 becomes smaller than the input interval in which the digital audio signal 78 is inputted to the audio signal encoding circuit 79. Further, the digital audio signal 78 inputted to the audio signal encoding circuit 79 has a plurality of bits for each sample, while output of the digital audio signal 49 encoded by the audio signal encoding circuit 79 is serially performed. These differences between the input interval and output interval and between input bit number and output bit number are compensated by carrying out coding for compression of data quantity in the audio signal encoding circuit 79, or by performing the output of the digital audio signal 49 more faster than the input of the digital audio signal 78.

Returning to FIG. 45, the audio signal synthesizing circuit 50 has the same configuration as the horizontal dividing signal synthesizing circuit 36 whose configuration is shown previously in FIG. 2. As shown in FIG. 17, the digital audio signal 49 inputted from the audio signal generating circuit 95 is superposed to the vertical sync signal 21, to be outputted as the second vertical sync signal 51. Accordingly, this second vertical sync signal 51 is equivalent to the vertical sync signal 21 as a TTL logic signal. In accordance with the voltage thresholds of TTL logic, the voltage value of the second vertical sync signal 51 is 2.0 or more in the interval that the vertical sync signal 21 is logical 1, and 0.8 v or less in the interval that the vertical sync signal 21 is logical 0. Further, at the same time, in the interval that the vertical sync signal 21 is logical 1, the second vertical sync signal 51 takes the voltage values corresponding to the logical values of the digital audio signal 49 within the range of the voltage level of logical 1 of the TTL logic. In other words, the voltage value of the second vertical sync signal 51 is 5.0 v in the interval that the digital audio signal 49 is logical 1, and 4.8 v in the interval that the digital audio signal 49 is logical 0.

Next, in the liquid crystal display monitor 24, the above-described second vertical sync signal 51 is inputted into the audio signal isolating circuit 52, and separated into the vertical sync signal 53 and digital audio signal 54. The audio signal isolating circuit 52 has a configuration similar to the sync signal isolating circuit 38 shown previously in FIG. 5. As shown in FIG. 17, the audio signal isolating circuit 52 shapes the waveform of the second vertical sync signal 51 in accordance with the TTL logic thresholds, and outputs the shaped signal as the vertical sync signal 53. Further, the audio signal isolating circuit 52 converts the second vertical sync signal 51 to a TTL logic signal having logical values corresponding to the micro voltage levels of the second vertical sync signal 51, and outputs the converted signal as the digital audio signal to the audio signal reproduction circuit 55.

Figure 30:
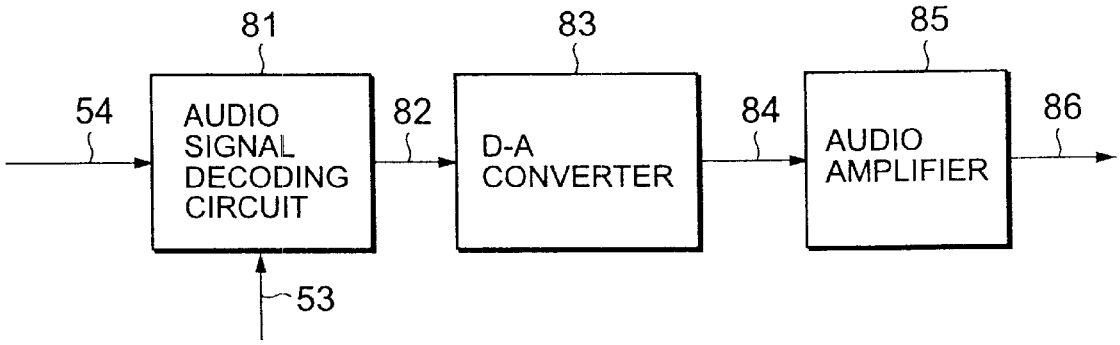
FIG. 30 is a block diagram showing a configuration of audio signal reproduction circuit according to the ninth embodiment of the present invention.

FIG. 30 shows a configuration of this audio signal reproduction circuit 55.

As shown in the figure, the audio signal reproduction circuit 55 comprises an audio signal decoding circuit 81, a D-A converter 83, and an audio amplifier 85.

Figure 31:
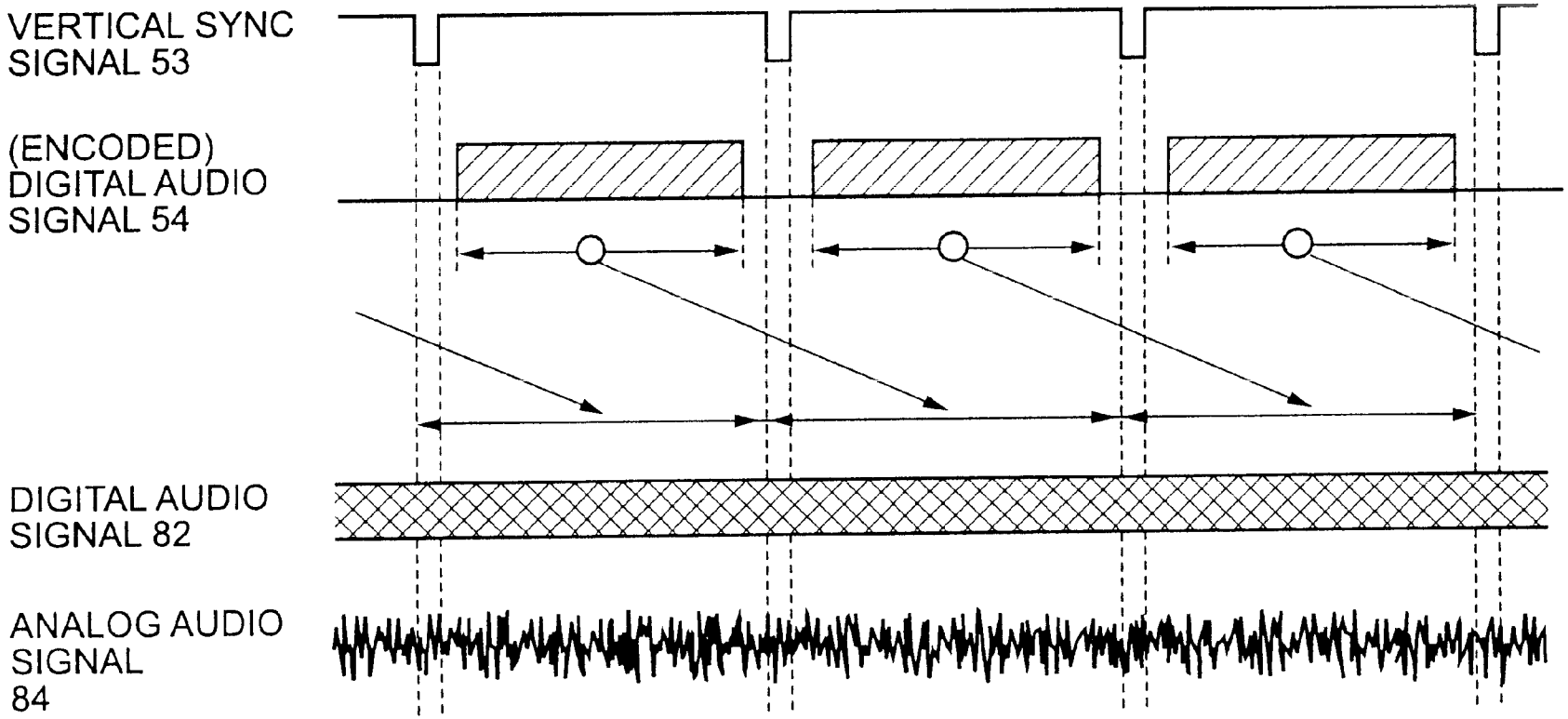
FIG. 31 is a view showing reproduction of the audio signal relating to the ninth embodiment of the present invention.

As shown in FIG. 31, the audio signal decoding circuit 81 decodes the digital audio signal 54 inputted from the audio signal isolating circuit 52, for each unit of digital audio signal 54 defined as the signal 54 corresponding to each vertical interval expressed by the vertical sync signal 53. The digital audio signal 54 inputted in the prescribed interval defined in relation to an interval in which the vertical sync signal 53 is of Low-voltage within each vertical interval is decoded to obtain a plurality of bits of digital audio signal 82. The digital audio signal 82 is outputted to the D-A converter 83 in the next vertical interval, at the same rate as the sampling rate at which the digital audio signal was subject to the A-D conversion. As a result, output of the digital audio signal 82 to the D-A converter 83 is carried out so as not to break for each vertical interval.

The D-A converter 83 converts the inputted digital audio signal 82 to analog audio signal 84, and the audio amplifier 85 amplifies the analog audio signal 84 and outputs it to the speaker 56 shown in FIG. 45.

Hereinabove, the ninth embodiment of the present invention has been described.

In the present embodiment, encoding and decoding of the digital audio signal give rise to delay of one vertical interval for each processing, i.e., two vertical intervals in total. Generally, the vertical interval is 16 msec or less, and, thus, the delay is 32 msec or less. Such degree of delay does not matter in practice. Of course, however, certain arrangement may be provided for absorbing that delay on the side of the graphics card 1 or the liquid crystal display monitor 24. For example, this may be carried out, in the graphics card 1, by delaying reading of the video signal by two vertical intervals in relation to the audio signal.

Alternatively, encoding and decoding of the digital audio signal may be carried out not for each vertical interval but for each unit of a shorter interval.

In the above embodiment, on the side of the graphics card 1, digital audio signal is superposed in a prescribed interval defined in relation to the vertical sync signal to obtain the second vertical sync signal. And, on the side of the liquid crystal display monitor 24, the prescribed interval defined in relation to that vertical sync signal is used to find the interval in which the digital audio data has been superposed within the second vertical sync signal. Alternatively, on the side of the graphics card 1, prescribed identification patterns may be added before and after each continuous time part where the digital audio signal is superposed. On the side of the liquid crystal display monitor, these identification patterns are identified to find the interval in which the digital audio data has been superposed within the second vertical sync signal.

As described above, according to the present ninth embodiment, it is possible to transmit audio information from the graphics card 1 to the liquid crystal display monitor 24 without requiring a dedicated transmission line.

Now, a tenth embodiment of the present invention will be described.

Figure 32:
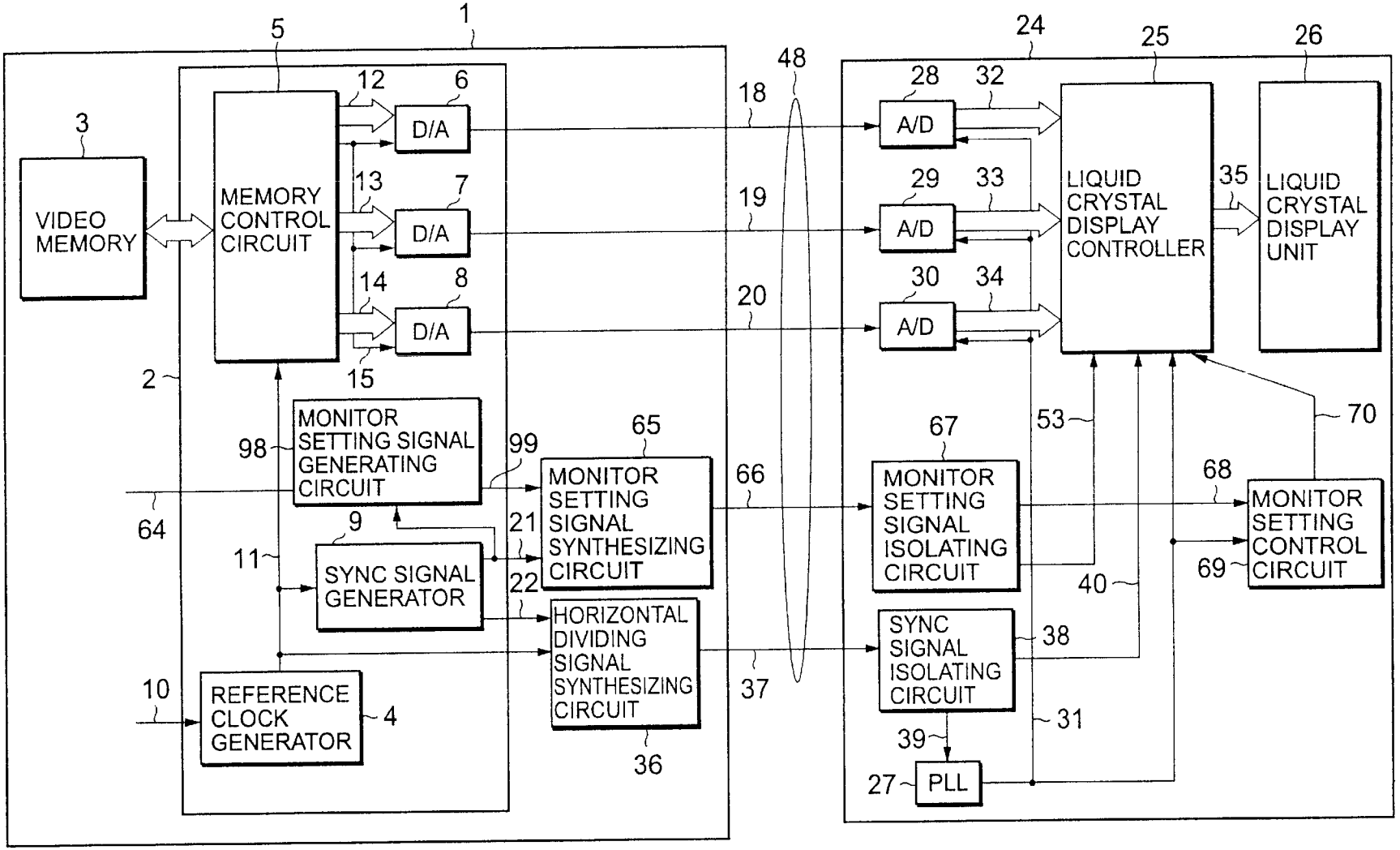
FIG. 32 is a block diagram showing a configuration of an image display system according to a tenth embodiment of the present invention.

FIG. 32 shows a configuration of an image display system of the tenth embodiment.

As shown in the figure, the image display system of the present embodiment is similar to the image display system of the sixth embodiment of FIG. 1 except that a monitor setting signal generating circuit 98 and a monitor setting signal synthesizing circuit 65 are added to the graphics card 1, and a monitor setting signal isolating circuit 67 and a monitor setting control circuit 69 are added to the liquid crystal display monitor 24.

According to the present embodiment, in the graphics card 1, the monitor setting signal synthesizing circuit 65 superposes monitor setting signal 64 generated by the monitor setting signal generating circuit 98 to the vertical sync signal 21, and outputs it as second vertical sync signal 66. On the other hand, in the liquid crystal display monitor 24, monitor setting signal isolating circuit 67 isolates the vertical sync signal 53 and the monitor setting signal 68 from the second vertical sync signal 66, and the monitor setting control circuit 69 changes setting of the liquid crystal display controller 25 in accordance with the isolated monitor setting signal 68. By this arrangement, it is possible, in the present tenth embodiment, to transmit the monitor setting signal between the graphics card 1 and the liquid crystal display monitor 24 without requiring a transmission line for transmission of the monitor setting signal.

In the following, details will be described.

Figure 33A:
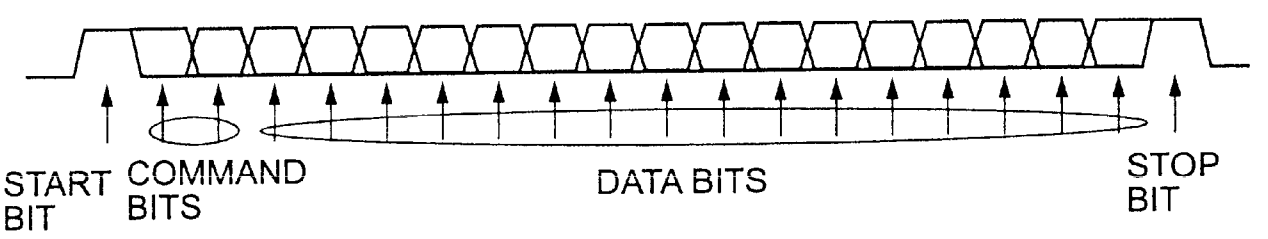
FIGS. 33A–33C are views showing monitor setting signals relating to the tenth embodiment of the present invention.

The monitor setting signal generating circuit 98 is provided with a register, into which monitor setting information is written from the outside. The monitor setting information is 18 bits in total, consisting of 2 bits of command bits and 16 bits of data bits. As shown in FIG. 33A, the monitor setting signal generating circuit 98 serializes the monitor setting information, adds a start bit and stop bit, each of 1 bit, before and after the serialized information to obtain a monitor setting signal 99. The monitor setting signal 99 is outputted to the monitor setting signal synthesizing circuit 65 in an interval that the vertical sync signal 21 generated by the sync signal generator 9 is not of Low-voltage.

Figure 34:
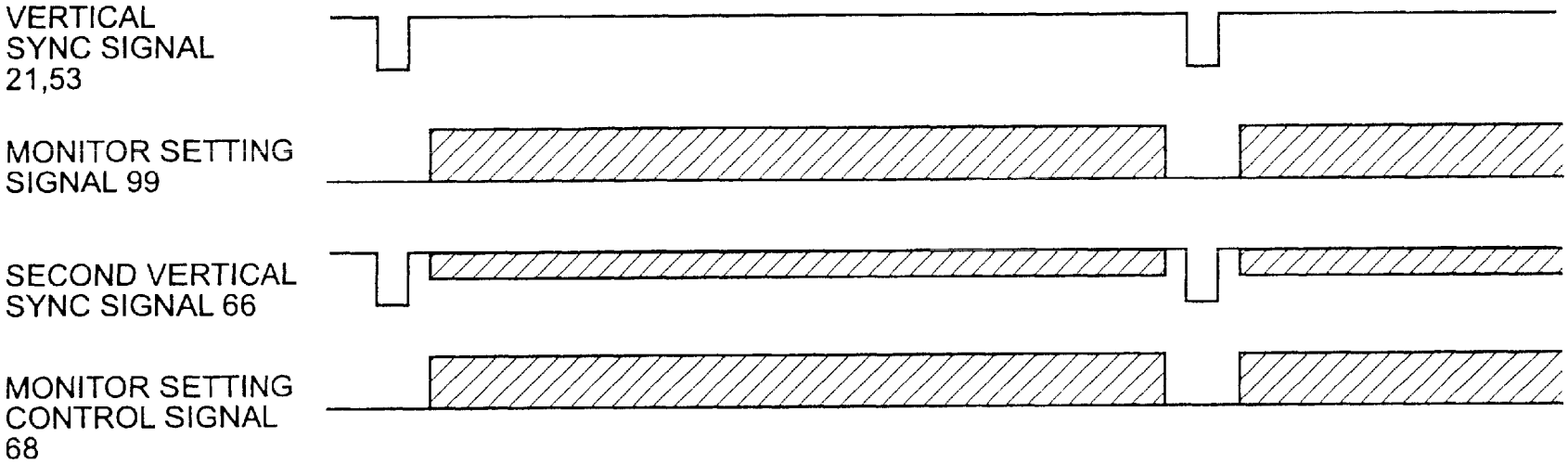
FIG. 34 is a view showing a second vertical sync signal relating to the tenth embodiment of the present invention.

The monitor setting signal synthesizing circuit 65 has the same configuration as the horizontal dividing signal synthesizing circuit 36 whose configuration is previously shown in FIG. 2. And, as shown in FIG. 34, the monitor setting signal 99 inputted from the monitor setting signal generating circuit 98 is superposed to the vertical sync signal 21, and outputted as the second vertical sync signal 66. Accordingly, as a TTL logic signal, this second vertical sync signal 66 is equivalent to the vertical sync signal 21. In accordance with the voltage thresholds of the TTL logic, the voltage value of the second vertical sync signal 66 is 2.0 v or more in the interval that the vertical sync signal 21 is logical 1, and 0.8 v or less in the interval that the vertical sync signal 21 is logical 0. Further, at the same time, in the interval that the vertical sync signal 21 is logical 1, the second vertical sync signal 66 takes the voltage values corresponding to the logical values of the monitor setting signal 99 within the range of the voltage level of logical 1 of the TTL logic. In other words, the voltage value of the second vertical sync signal 66 is 5.0 v in the interval that the monitor setting signal 99 is logical 1, and 4.8 v in the interval that the monitor setting signal 99 is logical 0.

On the other hand, in the liquid crystal display monitor 24, thus-described second vertical sync signal 66 is inputted into the monitor setting signal isolating circuit 67, and separated into the vertical sync signal 53 and the monitor setting signal 68. The monitor setting signal isolating circuit 67 has a configuration similar to the sync signal isolating circuit 38 shown previously in FIG. 5. As shown in FIG. 34, the monitor setting signal isolating circuit 67 shapes the waveform of the second vertical sync signal 66 in accordance with the TTL logic thresholds, and outputs the shaped signal as the vertical sync signal 53. Further, the monitor setting signal isolating circuit 67 converts the second vertical sync signal 66 to a TTL logic signal having logical values corresponding to the micro voltage levels of the second vertical sync signal 66, and outputs the converted signal as the monitor setting signal 68 to the monitor setting control circuit 69.

The monitor setting control circuit 69 monitors the monitor setting signal 68 being inputted. When the value of the monitor setting signal 68 becomes logical 1, the monitor setting control circuit 69 judges that the start bit is detected, takes in following 18 bits as the monitor setting information, and sets up the liquid crystal display controller 25 depending on the contents of that monitor setting information.

Here, various objects can be set by the monitor setting information, depending on the liquid crystal display monitor 24. In the present embodiment, description will be given, taking, for instance, a case where the monitor setting information sets the contents of a gamma correction table for deciding correspondence between values of the digital video signal and display gradation, and a case where the monitor setting information sets position of the display effective interval in the digital video signal, i.e., the interval in which effective video signal exists.

Figure 33B:
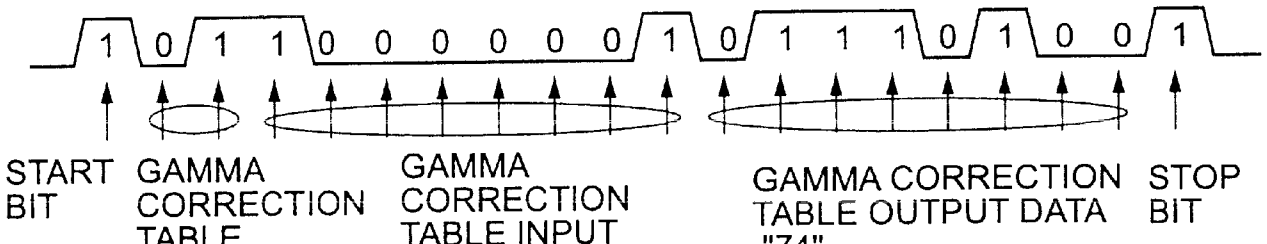

Now, as shown in FIG. 33B, when the command bits of the monitor setting information are "01", it means that this monitor setting information sets the gamma correction table. In that case, first 8 bits of the data bits express a value of the digital video signal, and the next 8 bits express a value of gradation corresponding to this value of the digital video signal.

Figure 33C:
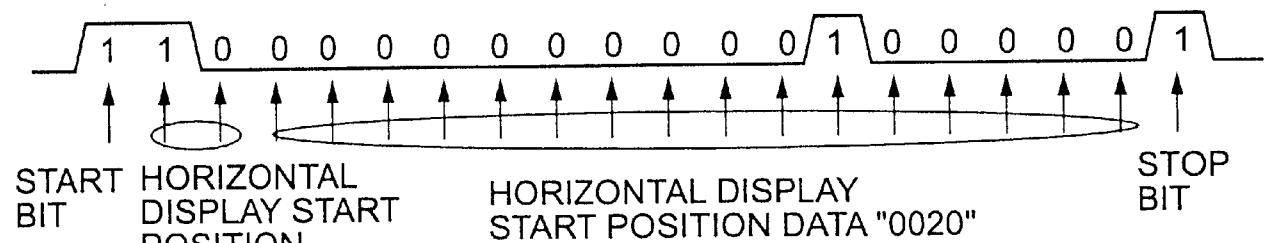

Next, as shown in FIG. 33C, when the command bits of the monitor setting information are "10", it means that this monitor setting information sets the beginning of the horizontal display effective interval. In that case, the data bits express, in terms of the number of clocks of the conversion clock 31, time distance of the horizontal display effective interval from the interval that the horizontal sync signal is of Low-voltage.

Figures 35, 36:
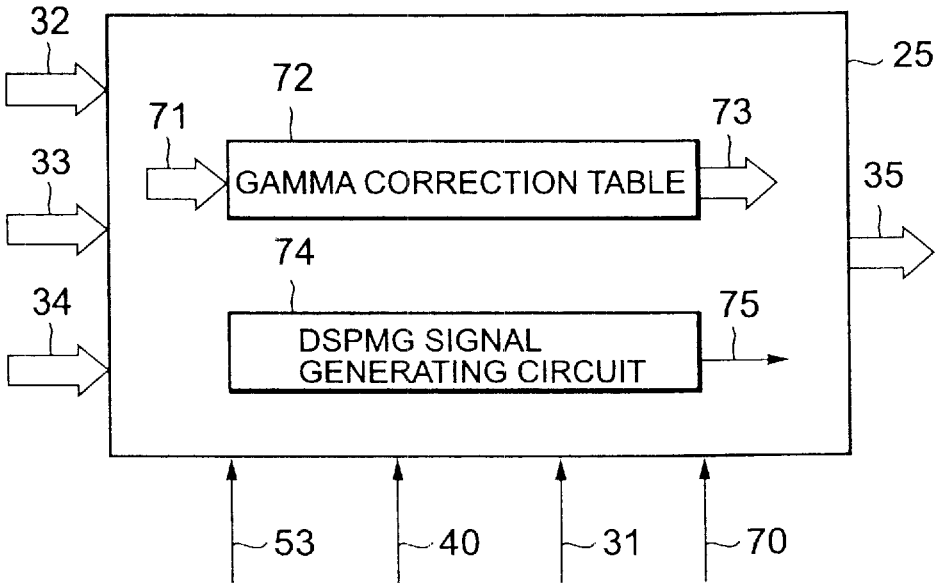
FIG. 35 is a view showing a configuration of a graphics controller relating to the tenth embodiment of the present invention.
FIG. 36 is a view showing contents of gamma correction table relating to the tenth embodiments of the present invention.

As shown in FIG. 35, the liquid crystal display controller 25 comprises a gamma correction table 72, and a DSPMG signal generating circuit 74.

Figure 37:
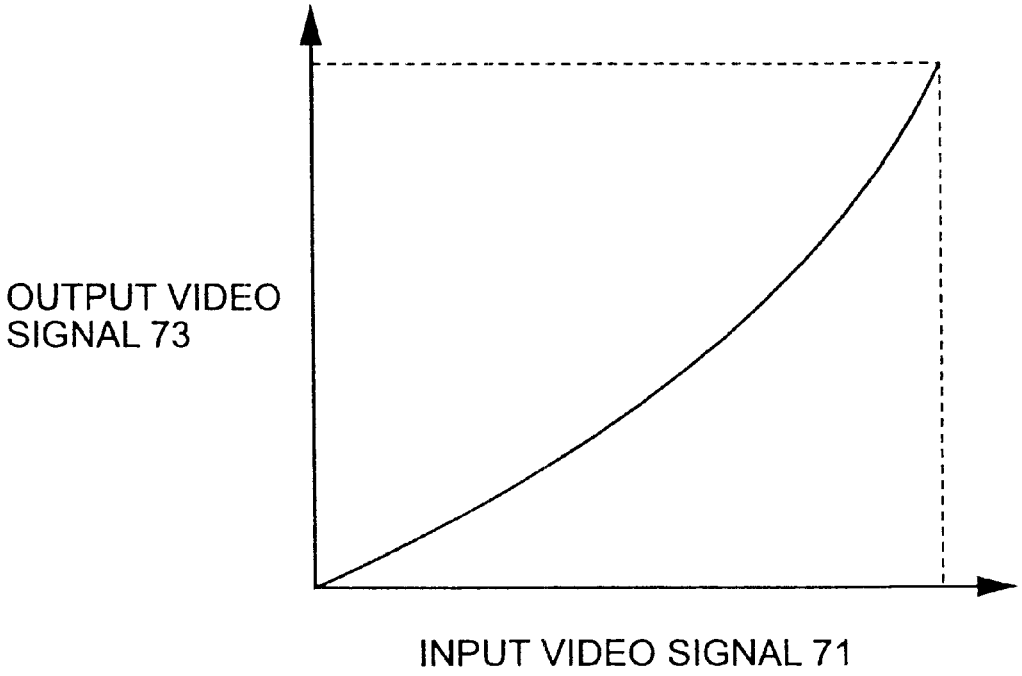
FIG. 37 is showing gamma characteristic relating to the tenth embodiment of the present invention.

As shown in FIG. 36, the gamma correction table 72 is a table that defines correspondence between a value of the digital video signal and a value of gradation. By changing the contents of this table, as shown in FIG. 37, it is possible to change the gradation characteristics of the liquid crystal display monitor 24, i.e., brightness, contrast, and hue. Here, generally, the gamma correction table 72 is constructed as a memory in which an address expresses a value of the digital video signal and data stored in each address expresses a value of gradation corresponding to the value of the digital video signal expressed by the address in question. The digital video signal is given as an address, contents of the memory at that address is read out, and that value is converted to a corresponding gradation value. In FIG. 35, the reference numeral 71 refers to the digital video signal 73 which is given as an address, and 73 to output video signal expressing a gradation value.

When the command bits of the monitor setting information are "01", the monitor setting control circuit 69 gives the first 8 bits of the data bits to the gamma correction table 72 as an address, and the next 8 bits are written into this address. In the case of FIG. 33B, the first 8 bits of the data bits express "81", and the next 8 bits express "74". Accordingly, when a value of the digital video signal 71 is "81", the output video signal 73 having a gradation value "74" is obtained.

Figure 38:
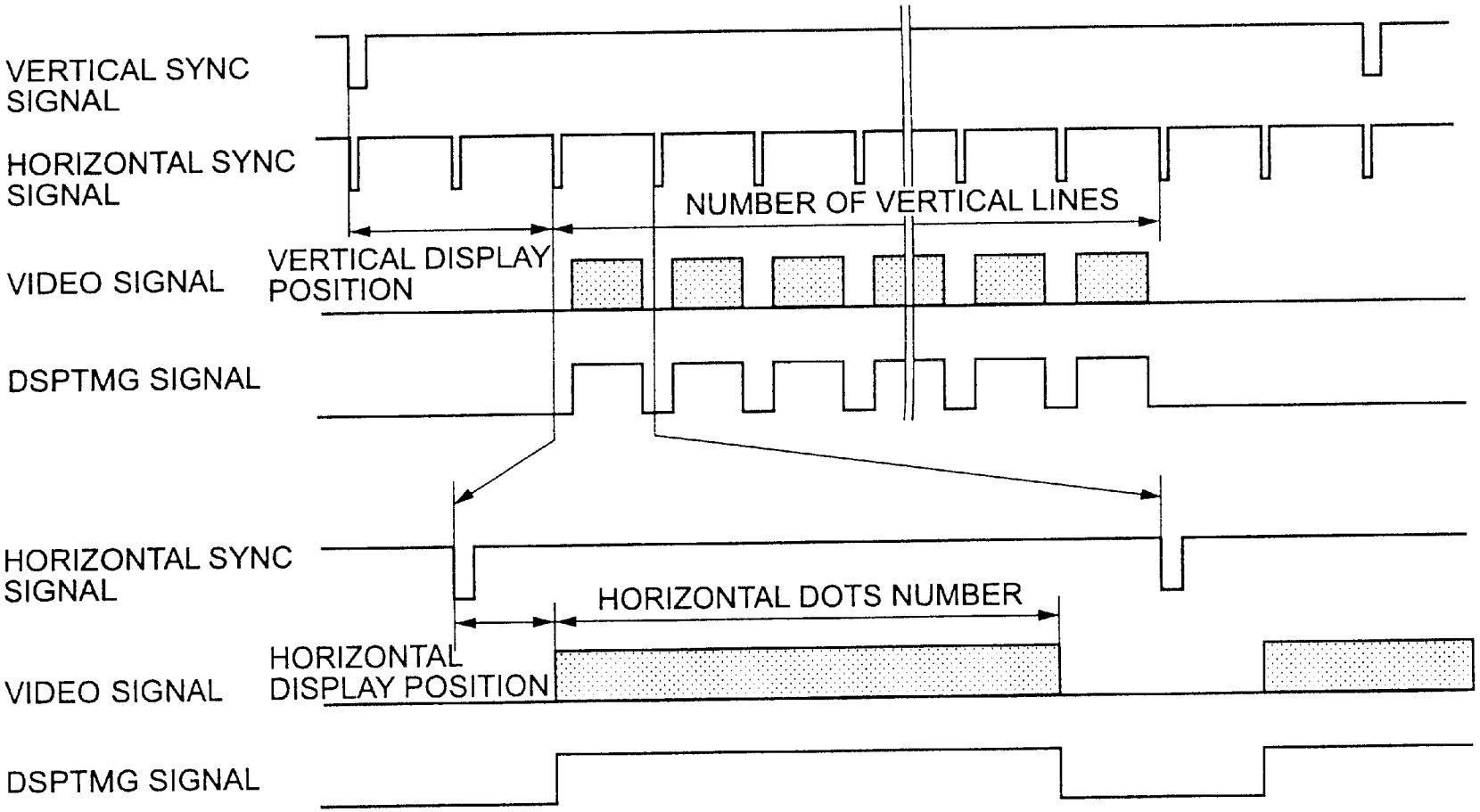
FIG. 38 is a view showing a relation between DSPMG signal and effective display interval relating to the tenth embodiment of the present invention.

Next, as shown in FIG. 38, the DSPMG signal generating circuit 74 is a circuit for generating a DSPMG signal that becomes High-level during the effective display interval. The liquid crystal display controller 25 takes in the digital video signal as effective, only in an interval that this DSPMG signal is High-level, and controls display depending on this digital video signal.

When the command bits of the monitor setting information are "10", the monitor setting control circuit 9 sets the value expressed by the data bits into the DSPMG signal generating circuit 74 as a value expressing time distance of the horizontal display effective interval from the interval in which the horizontal sync signal is of Low-voltage.

When the horizontal sync signal is changed to High-voltage in each-horizontal interval within an effective display interval of the vertical direction, the DSPMG signal generating circuit 74 counts the conversion clock by the number expressed by the set value, before it changes DSPMG signal to High-level. And, then, the DSPMG signal generating circuit 74 counts the conversion clock by the number of effective digital video signal of the horizontal direction, before it changes the DSPMG signal to Low-level.

Hereinabove, the tenth embodiment of the present invention has been described.

According to the present embodiment, it is possible to transmit various monitor setting information from the graphics card 1 to the liquid crystal display monitor 24 without requiring a dedicated transmission line.

The above ninth embodiment and the present tenth embodiment have been described as obtained by adding arrangement for transmitting the digital audio signal or monitor setting signal to the image display system of the above sixth embodiment. Alternatively, the arrangement for transmitting the digital audio signal or monitor setting signal may be similarly added to the above seventh embodiment or eighth embodiment.

Further, in the above ninth embodiment and the present tenth embodiment, the digital audio signal or the monitor setting signal is superposed to the vertical sync signal. However, in a case where the horizontal dividing signal or clock is not superposed to the horizontal sync signal or the composite sync signal, the digital audio signal or the monitor setting signal may be superposed to the horizontal sync signal or the composite sync signal. Otherwise, only when the horizontal sync signal belongs to the outside of the effective display interval of the vertical direction, the digital audio signal, instead of the horizontal dividing signal or clock, may be superposed to that horizontal sync signal.

Further, the above-described ninth embodiment and the present tenth embodiment can be effectively applied to an image display system that does not treat digitized video signal.

In the above, there have been described the embodiments of the image display system according to the present invention.

In the above description, there has been described the case where the display unit is a liquid crystal display monitor, by way of example. However, except for a liquid crystal display monitor, other kind of display unit such as a CRT or a plasma display may be used as a display unit. Further, there has been described the case where the graphics card is used for a digital video signal output device, by way of example. However, except for graphics card, other devices may be used, as far as it is a device that outputs digital video signal and sync signal.

As described above, according to the present invention, it is possible to provide an image display system that can transmits variety of signals from a video signal output device to a display unit without requiring a dedicated transmission line. Further, using thustransmitted signal, the present invention can reduce A-D conversion error in a display unit and prevent flicker of the display.

What is claimed is:

1. A video signal output device which outputs a video signal, comprising:

basic signal group generating means for generating a sync signal and a video signal, the video signal indicating display values of pixels at display positions on a display device in intervals of the video signal, the display positions being determined in accordance with time differences between the intervals of the video signal and the sync signal;

signal generating means for generating a transmission signal relating to the video signal to be transmitted to the display device;

superposing means for superposing the transmission signal on the sync signal to generate a second sync signal; and output means for outputting the second sync signal and the video signal;

wherein the transmission signal includes a control signal for controlling display of the video signal on the display device; and wherein the control signal adjusts a value of a gradation of the video signal as displayed on the display device.

2. A video signal output device according to claim 1, wherein the transmission signal further includes a clock signal for use in displaying the video signal on the display device.

3. A video signal output device according to claim 1, wherein the transmission signal further includes an audio signal relating to the video signal.

* * * * *